US006385556B1

(12) United States Patent
Kawano et al.

(10) Patent No.: US 6,385,556 B1
(45) Date of Patent: May 7, 2002

(54) METHOD AND SYSTEM FOR DETERMINING HEATING POINT AND HEATING LINE IN BENDING OF STEEL PLATE

(75) Inventors: Takayuki Kawano; Yoshiaki Inoue; Ryuuichirou Kikutsugi; Kazuaki Oota; Fukumi Hamaya; Hidetsugu Koiwa; Shouji Kawakado; Takeshi Nakahama, all of Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/834,604

(22) Filed: Apr. 16, 2001

Related U.S. Application Data

(62) Division of application No. 09/159,758, filed on Sep. 24, 1998, now Pat. No. 6,298,310.

(30) Foreign Application Priority Data

Sep. 29, 1997 (JP) ..... 9-263748
Sep. 29, 1997 (JP) ..... 9-263751
Sep. 16, 1998 (JP) ..... 10-261088
Sep. 16, 1998 (JP) ..... 10-261089

(51) Int. Cl.[7] ..... B21D 11/20

(52) U.S. Cl. ..... 702/155; 702/136; 72/342.1; 219/602

(58) Field of Search ..... 702/136, 155; 219/602, 603; 72/342.1, 342.5, 342.6

(56) References Cited

U.S. PATENT DOCUMENTS 4,120,187 A 10/1978 Mullen

FOREIGN PATENT DOCUMENTS

EP 0575646 A1 12/1993
WO 94021402 A1 9/1994
WO 95002475 A1 1/1995

OTHER PUBLICATIONS

Patent Abstracts of Japan, Abstract for JP 07–075835A, published Mar. 20, 1995.

Patent Abstracts of Japan, Abstract for JP 07–060368A, published Mar. 7, 1995.

Patent Abstracts of Japan, Abstract for JP 07–024534A, published Jan. 27, 1995.

Patent Abstracts of Japan, Abstract for JP 6–000541A, published Jan. 11, 1994.

Patent Abstracts of Japan, Abstract for JP 06–226360A, published Aug. 16, 1994.

*Primary Examiner*—Kamini Shah

(57) ABSTRACT

A method and a system for determining a heating point and a heating line in steel plate bending place a virtual wooden pattern on a virtual steel plate; roll the wooden pattern or steel plate along a frame line from a reference position to contact the wooden pattern and steel plate at two points A, B on the steel plate and C, D on the wooden pattern; roll the wooden pattern or steel plate in the reverse direction for return to the reference position; obtain straight lines U, V connecting the contact points A, B and C, D, respectively; determine a heating point relative to a reference point based on an intersection point of the straight lines U, V; repeat the same steps while contacting the contact points A, C on a reference point side to use their contact point as a new reference point, to determine respective heating points along a specific line up to the end of the steel plate; draw straight lines from a certain heating point on a certain line to heating points on other lines based on the determined heating points; examine the degree of parallelism between each straight line and a roller line; if the degree is within a predetermined range, group the relevant heating points as the same group; and connect the heating points of the same group by a straight line or a curve to determine a heating line.

4 Claims, 21 Drawing Sheets

Before heating

After heating

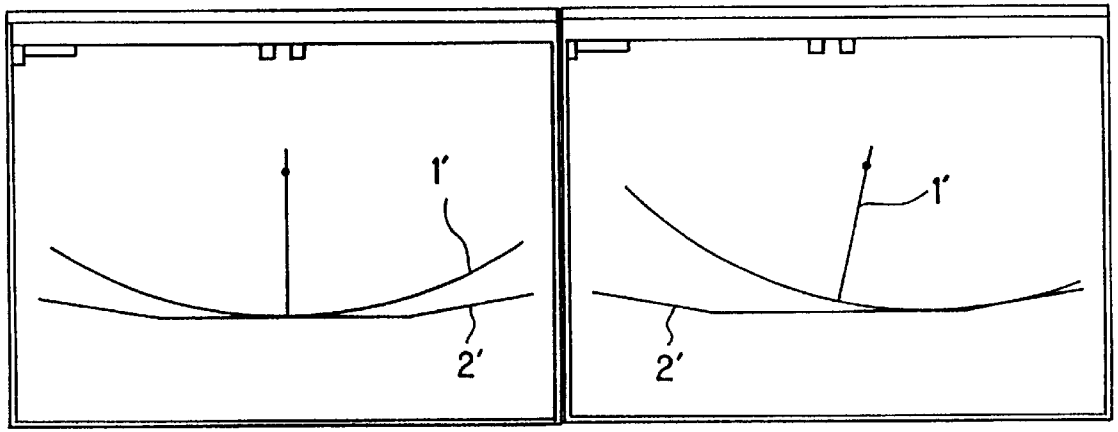
FIG. 7(a)
FIG. 7(b)
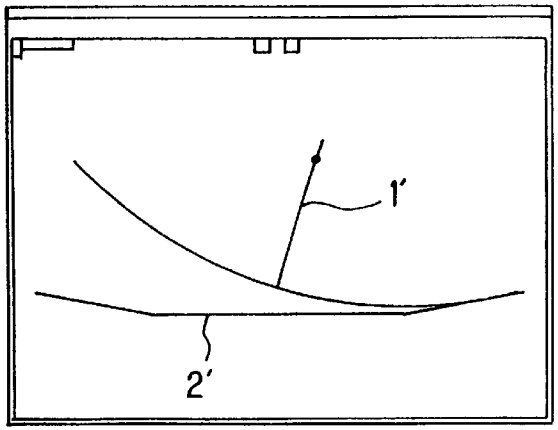
FIG. 7(c)

METHOD AND SYSTEM FOR DETERMINING HEATING POINT AND HEATING LINE IN BENDING OF STEEL PLATE

This application is a divisional of application Ser. No. 09/159,758, filed on Sep. 24, 1998, now U.S. Pat. No. 6,298,310 the entire contents of which are hereby incorporated by reference and for which priority is claimed under 35 U.S.C. §120; and this application claims priority of Application Nos. 9-263748; 9-263751; 10-261088; and 10-261089 filed in Japan on Sep. 29, 1997; Sep. 29, 1997; Sep. 16, 1998; and Sep. 16, 1998 under 35 U.S.C. §119.

BACKGROUND OF THE INVENTION

1. Field of the Invention

This invention relates to a method and a system for determining a heating point and a heating line in the bending of a steel plate. More specifically, the invention relates to the method and system useful for application to the bending of a steel plate having complicated curved surfaces, such as an outer panel of a ship hull.

2. Description of the Prior Art

The outer panel of a ship hull is composed of a steel plate about 10 to 30 mm thick with a complicated undevelopable curved surface which reduces propulsion resistance for efficient navigation in the water. To form this curved outer panel, a processing method generally called line heating has been known for long. This method heats the surface of a steel plate locally by means of a gas burner or the like, to cause the extraplane angular deformation or intraplane shrinkage deformation of the steel plate due to plastic distortion, and skillfully combines these deformations to obtain the desired shape. This method is used at many shipyards.

FIG. 1 is an explanation drawing conceptually showing an earlier technology concerned with a method for bending a steel plate to serve as an outer panel of a ship hull. FIG. 2 is a front view showing a wooden pattern for use in the bending in a state in which it is mounted on the steel plate. As shown in both drawings, according to the earlier technology, many (10 in the drawing) wooden patterns 1 following frame lines of the outer panel of the ship hull (lines extending along frame materials for the outer panel at positions where the frame materials are attached; the same will hold in the following description) as target shapes are mounted on a steel plate 2. Then, an operator compares the shapes of each wooden pattern 1 and the steel plate 2 by visual observation, and considers differences between their shapes, e.g., the clearance between the wooden pattern 1 and the steel plate 2. Based on this consideration, the operator studies what position to heat in order to bring the steel plate 2 close to the target shape. As a result, the operator determines each heating position (heating point). Concretely, the wooden pattern 1 is rolled along the frame line of the steel plate 2 in a vertical plane (the same plane as in FIG. 2). The points of contact of the wooden pattern 1 with the steel plate 2 during the rolling motion are watched to determine the heating points in consideration of the clearance between the wooden pattern 1 and the steel plate 2 in each state.

Then, it is considered how to connect the respective heating points together in order to make the steel plate 2 similar to the target shape. Based on this consideration, a heating line is determined. As shown in FIG. 3, heating lines 3 that have been determined are marked on the surface of the steel plate 2 with chalk or the like, and the steel plate 2 is heated with a gas burner along the heating lines 3.

With the earlier technology as described above, the steel plate 2 is heated with a gas burner by the operator along the heating lines 3 determined by the operator's sense based on many years of experience. As a result, a predetermined curved surface is obtained. Acquiring the ability to determine the heating lines 3 rationally is said to require more than about 5 years of experience. This has posed the problems of the aging and shortage of experienced technicians. The bending procedure also takes a large amount of time for incidental operations, such as the production, mounting and removal of the wooden pattern 1 for the steel plate 2, thus lengthening the entire operating time.

To solve the problem of the shortage of experienced technicians and reduce the operating time, it is necessary to improve, theorize and automate the bending operation while taking into consideration know-how that operators acquired through experience.

SUMMARY OF THE INVENTION

The present invention solves the above-described problems with the earlier technologies. The object of this invention is to provide a method and a system for determining a heating point and a heating line in steel plate bending, the method and system being capable of determining the heating point and heating line without using a wooden pattern, and being capable of assisting in the automatic determination of the heating point and heating line.

The invention that attains the foregoing object is characterized by the following aspects:

1) Placing a virtual wooden pattern formed from target shape data on a virtual steel plate formed from steel plate shape measurement data, the target shape data being related to a target shape of a steel plate to be bent, and the steel plate shape measurement data being obtained by measuring a surface shape of the steel plate; rolling the wooden pattern or steel plate along a specific line on the steel plate, such as a frame line, from a predetermined reference position in a plane including a cross section of the steel plate, to bring the wooden pattern and the steel plate into contact at two points, with the contact points on the steel plate being designated as A, B, and the contact points on the wooden pattern being designated as C, D; then rolling the wooden pattern or the steel plate in the reverse direction to return it to the reference position; with the wooden pattern or the steel plate being returned to the reference position, obtaining a straight line U connecting the contact points A, B and a straight line V connecting the contact points C, D; and determining a heating point on the basis of a point of intersection of the straight lines U, V, and also determining a bending angle for the steel plate at the heating point on the basis of an angle of intersection of the straight lines U, V;

after obtaining a heating point, or a heating point and a bending angle, relative to a certain reference point, repeating the same steps as described above while bringing the contact points A, C on a reference point side, which have been used in the determination of the heating point, into contact with each other to use their contact point as a new reference point, thereby determining respective heating points, or respective heating points and respective bending angles, along a specific line up to the end of the steel plate;

drawing straight lines from a certain heating point on a certain line, as a starting point, to heating points on other lines on the basis of the heating points that have been determined in this manner; examining the degree of parallelism between each of the straight lines and a roller line involved during primary bending of the steel plate; if the degree of parallelism is within a predetermined range, performing grouping of the relevant heating points as the heating points of the same group; and connecting the respective heating points of the same group by a straight line or a curve to determine a heating line; or drawing straight lines from a certain heating point on a certain line, as a starting point, to heating points on other lines on the basis of the heating points that have been determined; examining the degree of parallelism between each of the straight lines and a roller line involved during primary bending of the steel plate; if this degree of parallelism is within a predetermined range, performing grouping of the relevant heating points as the heating points of the same group; and connecting the respective heating points of the same group by a straight line or a curve to determine a heating line, and also imparting as data the amounts of heating at the respective heating points that have been determined on the basis of the bending angles of the steel plate at the respective heating points; or drawing straight lines from a certain heating point on a certain line, as a starting point, to heating points on other lines on the basis of the heating points that have been determined; examining the degree of parallelism between each of the straight lines and a roller line involved during primary bending of the steel plate; if this degree of parallelism is within a predetermined range, and if the amounts of heating at the heating points determined by the bending angles of the steel plate at the respective heating points are equal to each other, performing grouping of the relevant heating points as the heating points of the same group; and connecting the respective heating points of the same group by a straight line or a curve to determine a heating line.

2) Having a heating point determining unit which reads in target shape data on a target shape of a steel plate to be bent, and steel plate shape measurement data obtained by measuring a surface shape of the steel plate; places a virtual wooden pattern formed from the target shape data on a virtual steel plate formed from the steel plate shape measurement data; rolls the wooden pattern or steel plate along a specific line on the steel plate, such as a frame line, from a predetermined reference position in a plane including a cross section of the steel plate, to bring the wooden pattern and the steel plate into contact at two points, with the contact points on the steel plate being designated as A, B, and the contact points on the wooden pattern being designated as C, D; then rolls the wooden pattern or the steel plate in the reverse direction to return it to the reference position; with the wooden pattern or the steel plate being returned to the reference position, obtains a straight line U connecting the contact points A, B and a straight line V connecting the contact points C, D; calculates the three-dimensional coordinates of a heating point on the basis of a point of intersection of the straight lines U, V, and also calculates a bending angle for the steel plate at the heating point on the basis of an angle of intersection of the straight lines U, V; after obtaining a heating point, or a heating point and a bending angle, relative to a certain reference point, repeats the same steps as described above while bringing the contact points A, C on a reference point side, which have been used in the determination of the heating point, into contact with each other to use their contact point as a new reference point, thereby calculating respective heating points, or respective heating points and respective bending angles, along a specific line up to the end of the steel plate; and further having a heating line determining unit which reads in data on the heating points calculated by the heating point determining unit; draws straight lines from a certain heating point on a certain line, as a starting point, to heating points on other lines on the basis of data on the respective heating points; examines the degree of parallelism between each of the straight lines and a roller line involved during primary bending of the steel plate; if the degree of parallelism is within a predetermined range, performs grouping of the relevant heating points as the heating points of the same group; and connects the respective heating points of the same group by a straight line or a curve to determine a heating line; or a heating line determining unit which reads in data on the heating points and bending angles calculated by the heating point determining unit; draws straight lines from a certain heating point on a certain line, as a starting point, to heating points on other lines on the basis of data on the respective heating points; examines the degree of parallelism between each of the straight lines and a roller line involved during primary bending of the steel plate; if this degree of parallelism is within a predetermined range, performs grouping of the relevant heating points as the heating points of the same group; connects the respective heating points of the same group by a straight line or a curve to determine a heating line; and calculates the amounts of heating at the respective heating points on the basis of the data on the bending angles of the steel plate at the respective heating points; or a heating line determining unit which reads in data on the heating points and bending angles calculated by the heating point determining unit; draws straight lines from a certain heating point on a certain line, as a starting point, to heating points on other lines on the basis of data on the respective heating points and bending angles; examines the degree of parallelism between each of the straight lines and a roller line involved during primary bending of the steel plate; if this degree of parallelism is within a predetermined range, and if the amounts of heating at the heating points determined by the bending angles of the steel plate at the respective heating points are equal to each other, performs grouping of the relevant heating points as the heating points of the same group; and connects the respective heating points of the same group by a straight line or a curve to determine a heating line.

According to the aspects 1) and 2) above, all the heating points, or heating points and bending angles, on a specific line of the steel plate can be determined automatically. Furthermore, heating lines and bending angles (amounts of heating) can be determined simultaneously. Besides, appropriate heating lines can be prepared automatically on the basis of information on the heating points. Consequently, automatic bending of a predetermined steel plate can be carried out by controlling the position of the heating unit of the high frequency heater on the basis of data on the heating lines.

FIGS. 4(*a*) and 4(*b*) show, by contour lines, the shapes of a steel plate before and after its heating along heating lines determined by the present invention. FIG. 4(*a*) represents the contour lines before heating, indicating the difference between the shape of the steel plate and the target shape as a difference in color. A blue portion at the center of the steel plate has a difference of 5 mm from the target shape, while a red portion at the end of the steel plate has a difference of 50 mm. These findings demonstrate that the farther from the center and the nearer the end, the greater a deviation from the target shape becomes. FIG. 4(*b*), on the other hand, represents the contour lines after heating the steel plate along the heating lines of the present invention. A look at this drawing will show that a blue portion widens, so that the shape approaches the target shape markedly. That is, sufficiently useful heating lines can be determined without the need to use a wooden pattern concerned with earlier technologies.

3) Dividing a curve of a target shape of a steel plate to be bent, into a plurality of successive segments; similarly dividing a curve of a measured shape of the steel plate into a plurality of successive segments in correspondence with the curve of the target shape; determining the number of a plurality of congruent isosceles triangles, which are connected together while sharing their equal sides, for each segment on the basis of the radius of a division of the curve in each segment of the target shape of the steel plate, the radius of a division of the curve in each segment of the measured shape of the steel plate, and a separately set bending angle of the steel plate so that when the division of the curve in each segment of the target shape of the steel plate is regarded as an arc, the arc in each segment of the target shape of the steel plate can be approximated by a fold line defined by the bases of the plural congruent isosceles triangles and that when the division of the curve in each segment of the measured shape of the steel plate is regarded as an arc, the arc in each segment of the measured shape of the steel plate can be approximated by a fold line defined by the bases of a plurality of other congruent isosceles triangles which are connected together while sharing their equal sides, the number of the latter isosceles triangles being the same as the number of the former isosceles triangles whose bases constitute the approximating fold line for the target shape; dividing the arc of the measured shape in each segment by the number of the isosceles triangles to form respective points on the arc; and using the respective points on the arc as heating points.

4) Having a heating point determining unit which reads in target shape data on a target shape of a steel plate to be bent, and steel plate shape measurement data obtained by measuring a surface shape of the steel plate; divides a curve of the target shape of the steel plate into a plurality of successive segments; similarly divides a curve of the measured shape of the steel plate into a plurality of successive segments in correspondence with the curve of the target shape; determines the number of a plurality of congruent isosceles triangles, which are connected together while sharing their equal sides, for each segment on the basis of the radius of a division of the curve in each segment of the target shape of the steel plate, the radius of a division of the curve in each segment of the measured shape of the steel plate, and a separately set bending angle of the steel plate so that when the division of the curve in each segment of the target shape of the steel plate is regarded as an arc, the arc in each segment of the target shape of the steel plate can be approximated by a fold line defined by the bases of the plural congruent isosceles triangles and that when the division of the curve in each segment of the measured shape of the steel plate is regarded as an arc, the arc in each segment of the measured shape of the steel plate can be approximated by a fold line defined by the bases of a plurality of other congruent isosceles triangles which are connected together while sharing their equal sides, the number of the latter isosceles triangles being the same as the number of the former isosceles triangles whose bases constitute the approximating fold line for the target shape; divides the arc of the measured shape in each segment by the number of the isosceles triangles to form respective points on the arc; and calculates the coordinates of the respective points as heating points.

According to the aspects 3) and 4), the deviation of the surface shape of the steel plate, the object to be processed, from the target shape is grasped as a geometrical problem mediated by the angle between the base of each isosceles triangle and the base of the adjacent isosceles triangle of the multiplicity of specific isosceles triangles. Thus, all the heating points on a specific line of the steel plate can be determined automatically.

BRIEF DESCRIPTION OF THE DRAWINGS

FIGS. 7(*a*), 7(*b*) and 7(*c*) are explanation drawings showing displays of a display unit 16 associated with processing performed by the heating point determining unit 11 in FIG. 5;

DETAILED DESCRIPTION OF THE PREFERRED EMBODIMENTS

Embodiments of the present invention will now be described in detail with reference to the accompanying drawings. However, it is to be understood that these embodiments are given only for illustrative purposes and do not restrict the invention.

Figure 1:
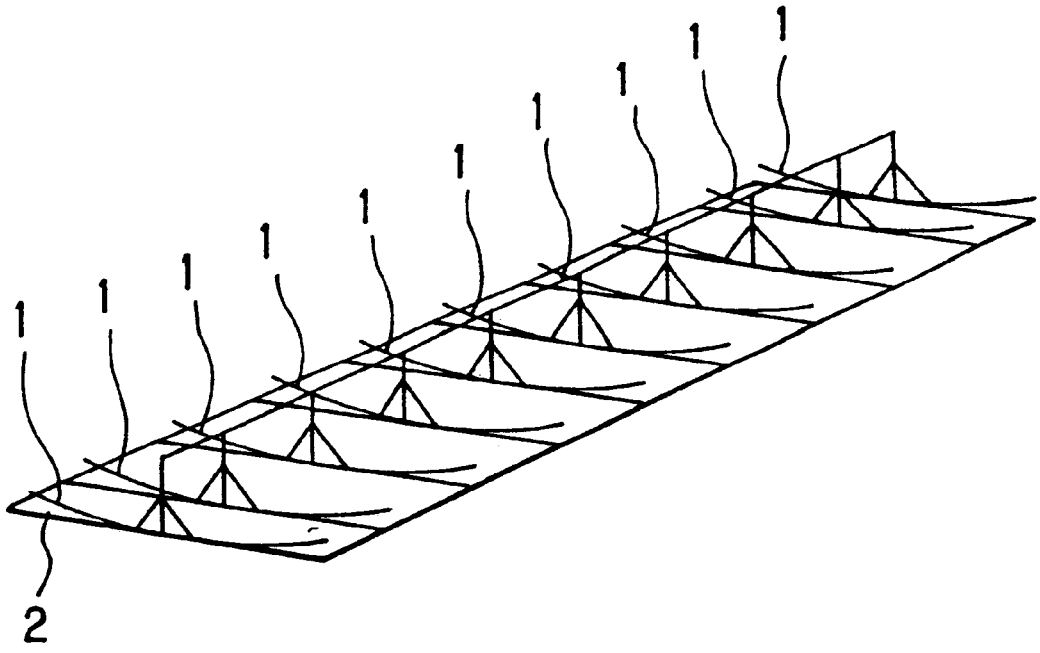
FIG. 1 PRIOR ART
FIG. 1 is an explanation drawing conceptually showing an earlier technology concerned with a method for bending a steel plate which will serve as an outer panel of a ship hull.
Figure 2:
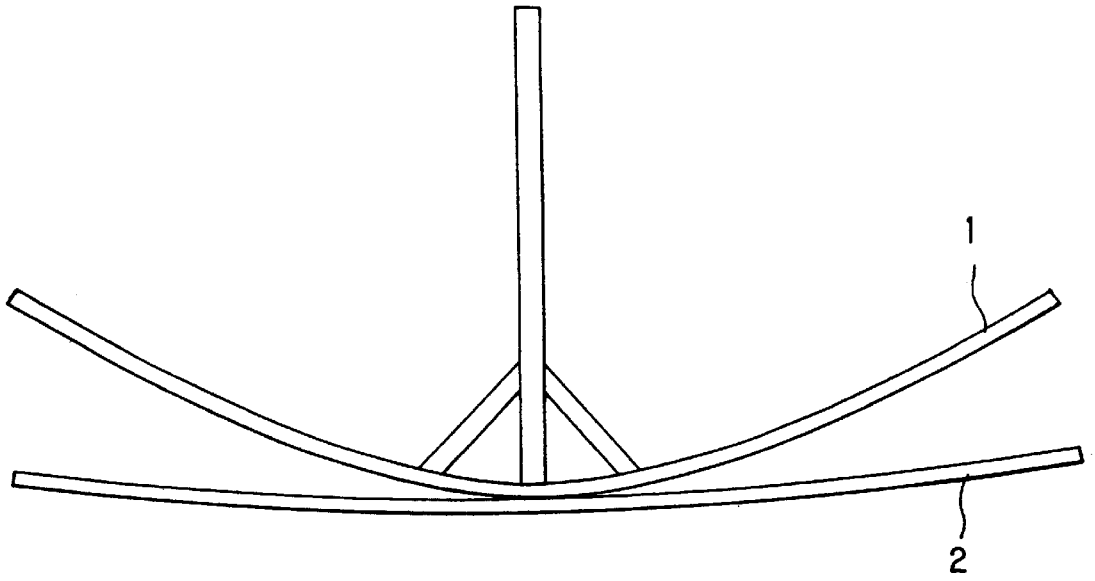
FIG. 2 PRIOR ART
FIG. 2 is a front view showing a wooden pattern for use in the bending of a steel plate according to the earlier technology, the wooden pattern being mounted on the steel plate.
Figure 3:
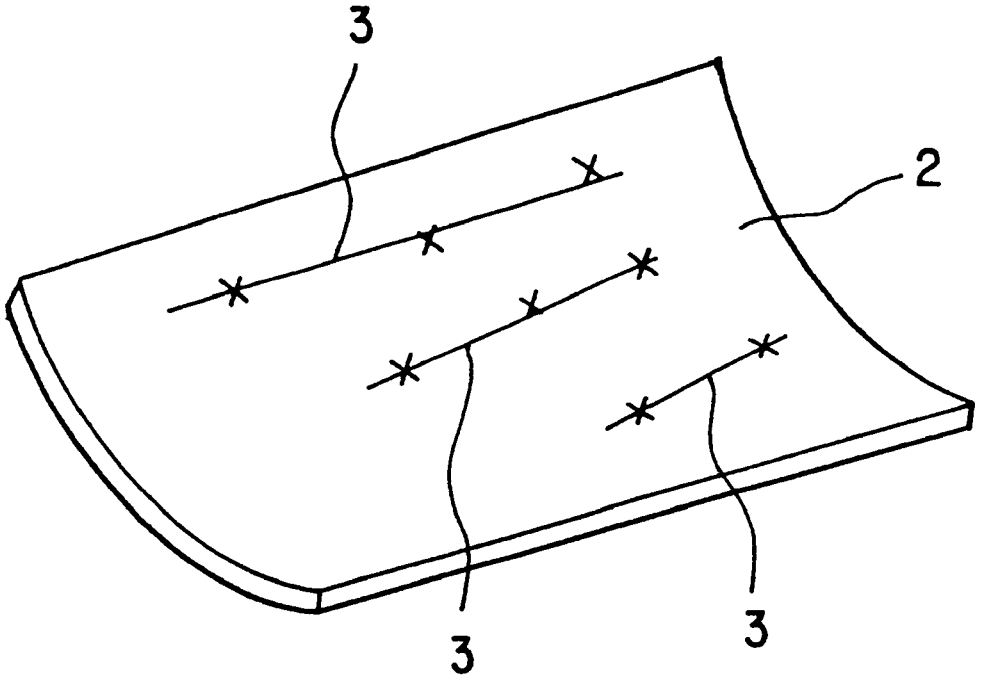
FIG. 3 PRIOR ART
FIG. 3 is a perspective view showing a state in which heating lines determined by the earlier technology are applied to a steel plate.
Figure 4A:
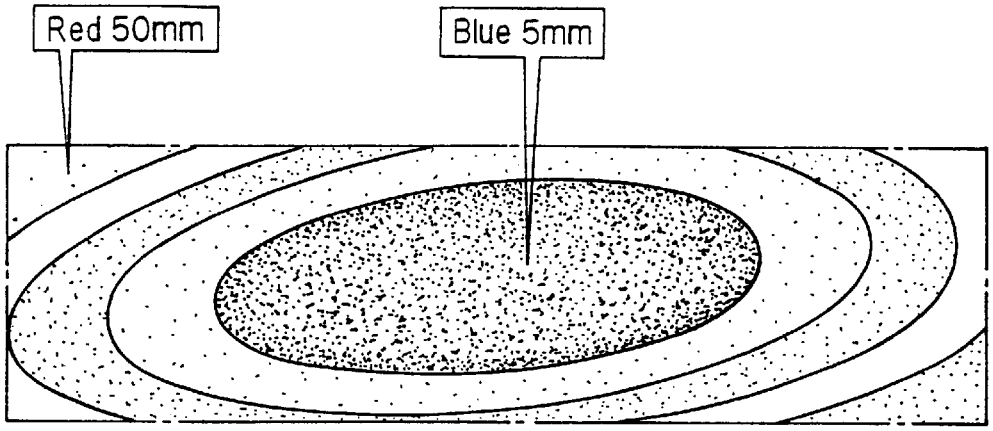
FIGS. 4(*a*) and 4(*b*) are schematic representations of the shape of a steel plate by contour lines for showing the results of experiments on the effects of the present invention.
Figure 4B:
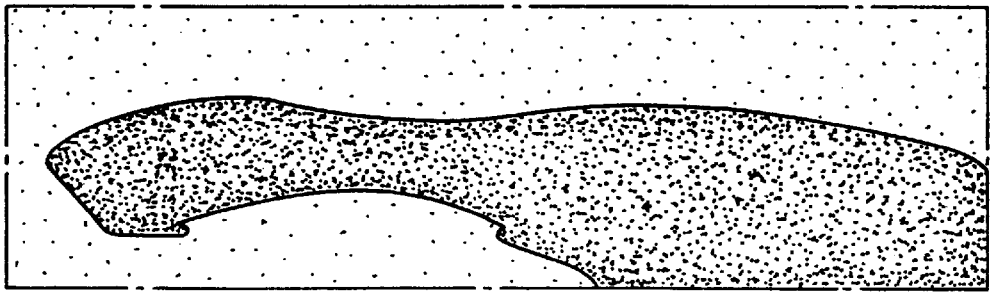
Figure 5:
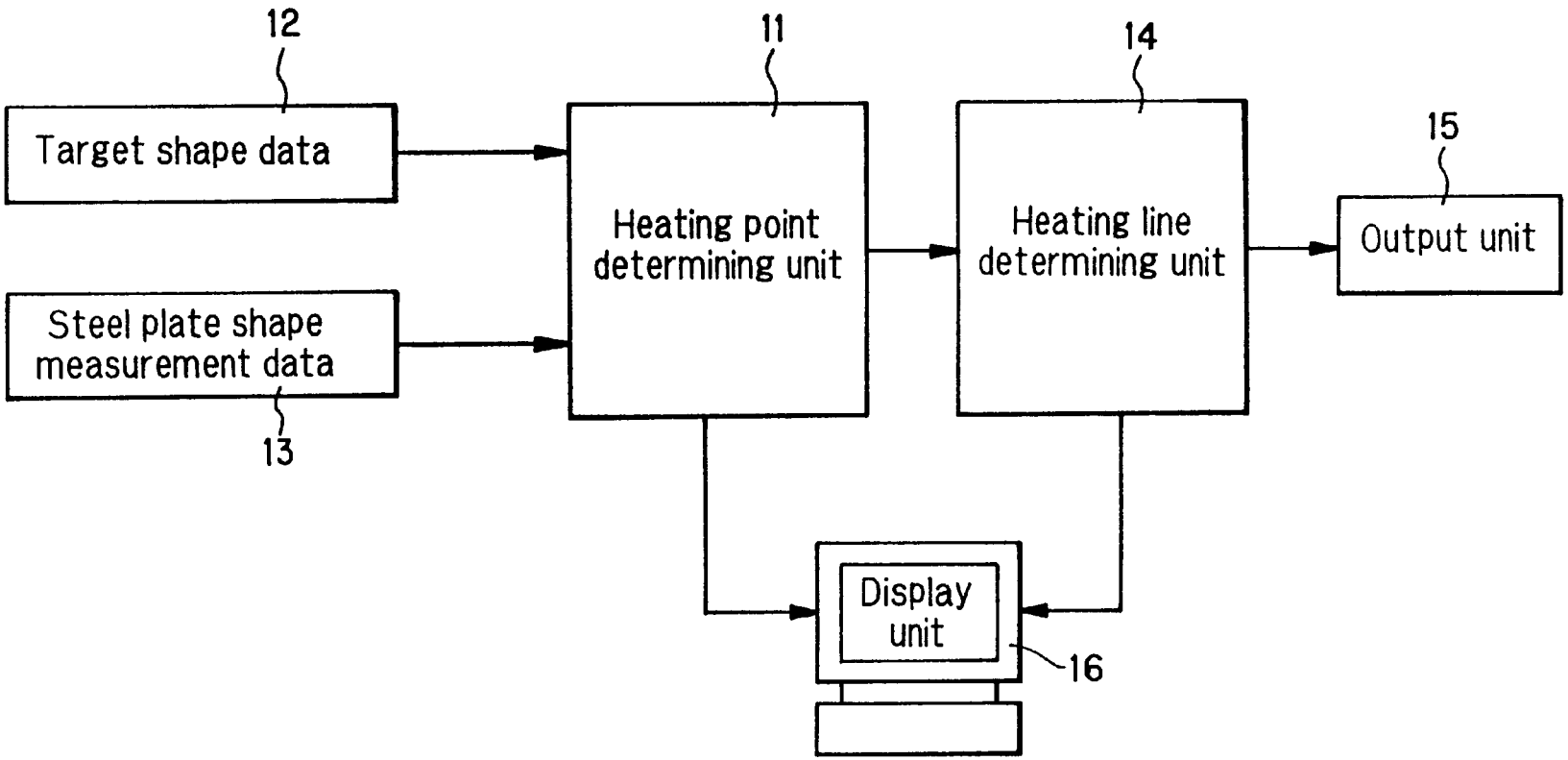
FIG. 5 is a block diagram showing a system for determining a heating point and a heating line in the bending of a steel plate concerned with an embodiment of the invention.
Figures 6A, 6B, 6C, 6D, 6E:
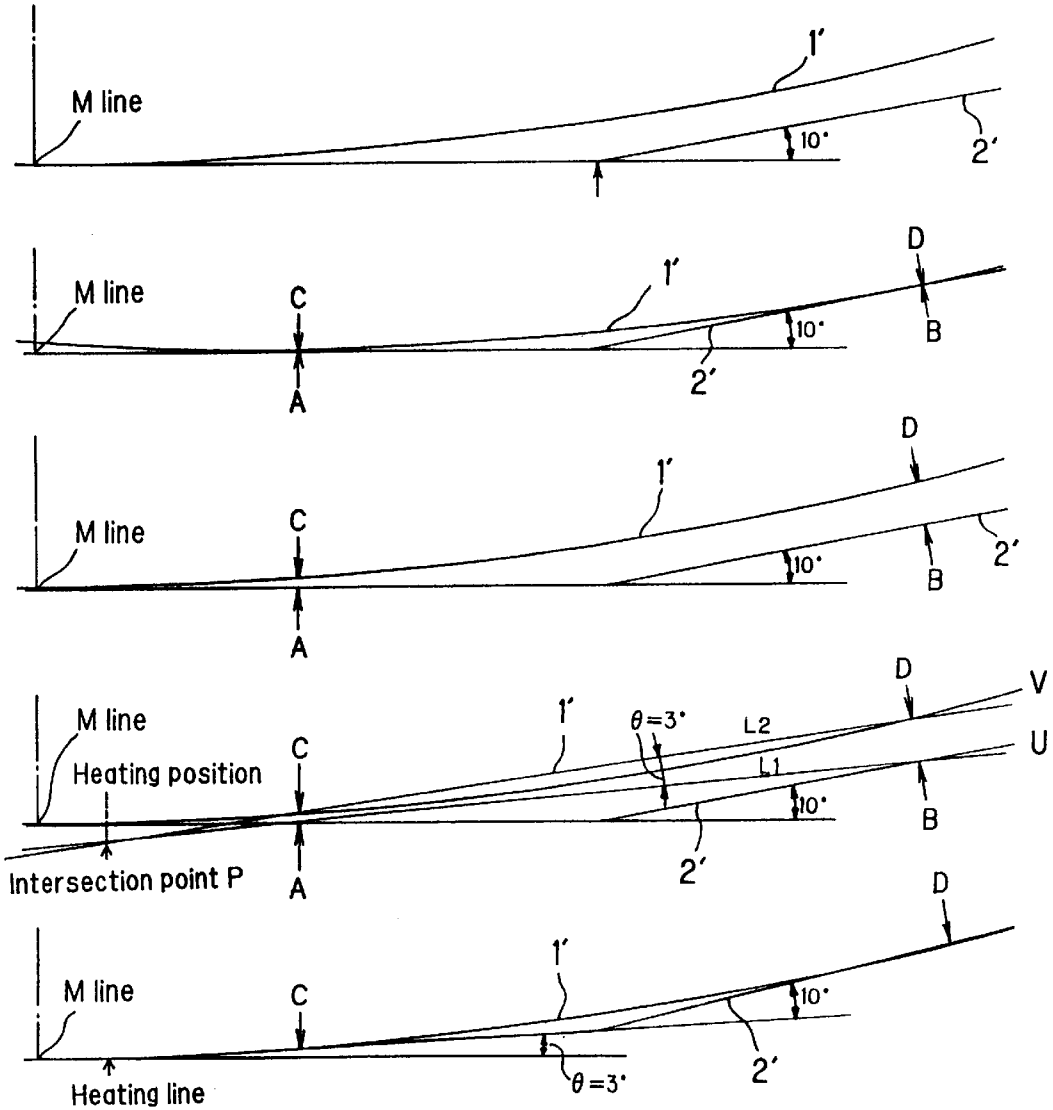
FIGS. 6(*a*) to 6(*e*) are explanation drawings for illustrating an example of processing performed by a heating point determining unit 11 in FIG. 5.

FIGS. 6(*a*) to 6(*e*) are explanation drawings for illustrating an example of processing performed by the heating point determining unit 11. In these drawings, the numeral 1' denotes a virtual wooden pattern for illustration, and the numeral 2' represents a similar virtual steel plate. The term "virtual" refers to the fact that the wooden pattern or steel plate at issue does not exist as a real one, but exists as electronic data or a graphic expressed in a visible form on the display unit 16. The processing in this example, as has been done by an operator, is to find the points of contact of the wooden pattern 1' with the steel plate 2' while rolling the wooden pattern 1', to determine a heating point. Thus, we call this method "a contact point finding method".

As shown in FIG. 6(*a*), the steel plate 2', the object to be bent, is assumed to be one of a curved shape that has been subjected to primary bending. Such steel plate 2', when observed on a minuscule scale, is thought not to have a smoothly varying curved surface, but to be a collection of flat surfaces bent at certain linear sites. For example, as shown in FIG. 6(*a*), the steel plate 2' forms a flat surface in a certain range beginning on an M line, the centerline in the plate width direction, and is bent at a certain position $\measuredangle$ to have an angle of 10°. On the other hand, a target shape that the wooden pattern 1' has is given as in FIG. 6(*a*). Thus, the wooden pattern 1' is rolled along a frame line from the initial position shown in FIG. 6(*a*), whereby the wooden pattern 1' is brought into contact with the steel plate 2' as shown in FIG. 6(*b*). At this time, contact points on the steel plate 2' are designated as A, B, while contact points on the wooden pattern 1' are designated as C, D. Then, the wooden pattern 1' is rolled in the reverse direction to return it to the initial state (the state shown in FIG. 6(*a*)) as shown in FIG. 6(*c*).

With the wooden pattern 1' being returned to the initial state, a straight line U connecting the contact points A, B and a straight line V connecting the contact points C, D are obtained to find an intersection point P of the straight lines U, V and an angle θ at which the straight lines U, V intersect. Based on this intersection point P, a heating point is determined. The angle θ (3° in FIG. 6) is deemed as a bending angle at the heating point. Actually, the intersection point P is extended vertically upward in FIG. 6(*d*) until it reaches the steel plate 2', to determine a heating position. The steel plate 2' is heated at this heating position, whereby it is bent by the angle θ, beginning at the heating position. This is a case shown in FIG. 6(*e*). As shown in this drawing, this heating results in the contact of the contact point B of the steel plate 2' with the contact point D of the wooden pattern 1', thus bringing the shape of the steel plate 2' close to the target shape (the shape of the wooden pattern 1'). Strictly speaking, there is a misalignment between the intersection point P and the heating position based thereon (there is a difference in the Z axis coordinate, the position in the vertical direction). In the bending at issue, however, the lengths of the straight lines U, V ranging from the intersection point P to the contact points B, D are sufficiently large relative to the angle θ. Hence, there is practically no harm in handling the intersection point P and the heating position based thereon as the same position.

Then, the same procedure (the procedure shown in FIGS. 6(*b*) to 6(*d*)) is performed, provided that the state of contact of the contact point C of the wooden pattern 1' with the contact point A represents a reference position corresponding to the aforementioned initial position. By this measure, a heating point and a bending angle θ at the heating point are determined. This procedure is repeated until the wooden pattern 1' is rolled to reach the end of the steel plate 2', whereby heating points and bending angles θ at the heating points are determined sequentially.

FIGS. 7(*a*) to 7(*c*) are explanation drawings conceptually illustrating display screens of the display unit 16 when the heating point is determined by the heating point determining unit 11. FIG. 7(*a*) corresponds to the initial position, FIG. 7(*b*) corresponds to a case in which the wooden pattern 1' is rolled once, and FIG. 7(*c*) corresponds to a case in which the wooden pattern 1' is rolled twice.

Figure 8:
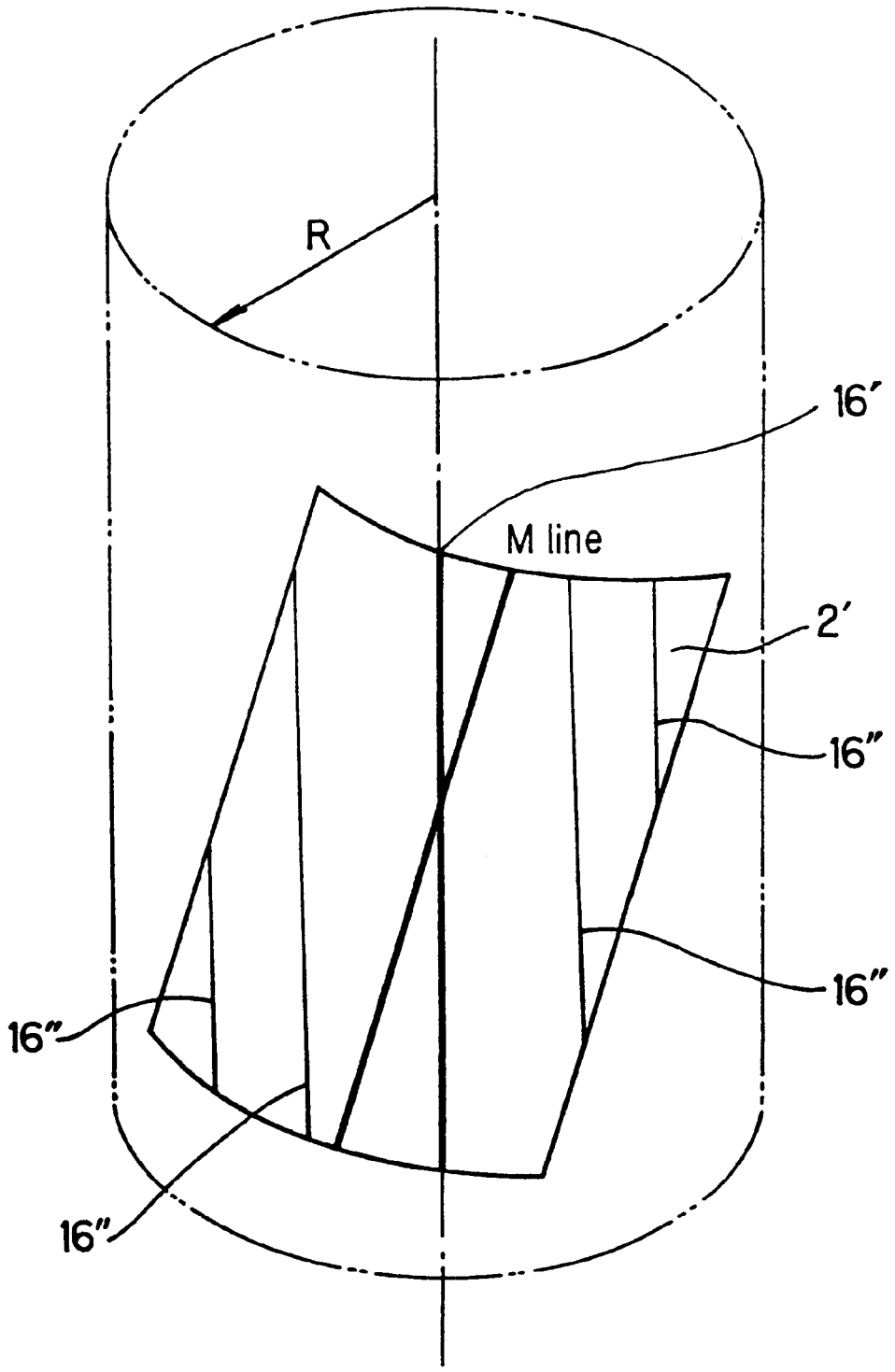
FIG. 8 is an explanation drawing conceptually showing the blank layout of a steel plate 2, an object to be processed, according to the instant embodiment.

FIG. 8 is an explanation drawing conceptually showing the blank layout of the steel plate 2, the object to be processed in the instant embodiment. As shown in FIG. 8, a virtual steel plate 2' which is a part of a cylindrical surface with a radius R taken out as in the drawing is assumed in the instant embodiment. To form this cylindrical surface approximately by bending, it is recommendable to bend the surface along the central axis of the cylinder so that its cross section is polygonal. That is, a roller reference line 16' is defined as indicating the direction of the central axis when the target shape is roughly deemed to be a cylindrical surface. FIG. 8 shows a case in which the M line, the centerline in the plate width direction, intersects the roller reference line 16'. The roller reference line 16' and the M line are not always in this relation. Since the steel plate 2' forms a part of the outer panel of a ship hull, for example, the roller reference line 16' and the M line may agree in a certain case.

Figure 9A:
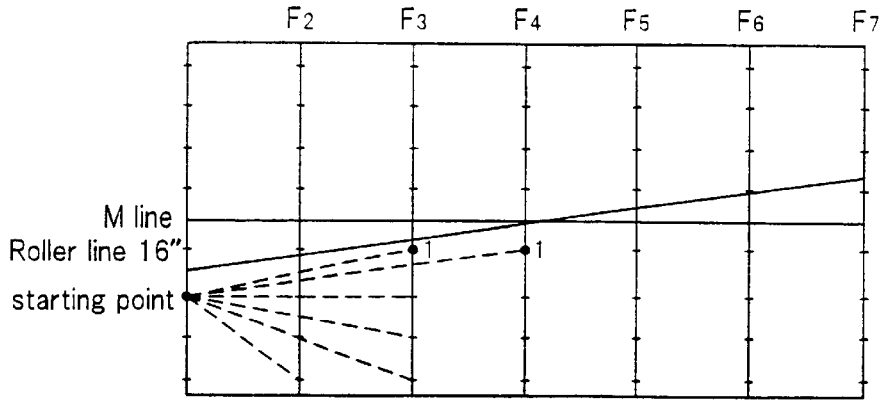
FIG. 9 is an explanation drawing for illustrating an example of processing performed by a heating line determining unit 14 in FIG. 5.
Figure 9B:
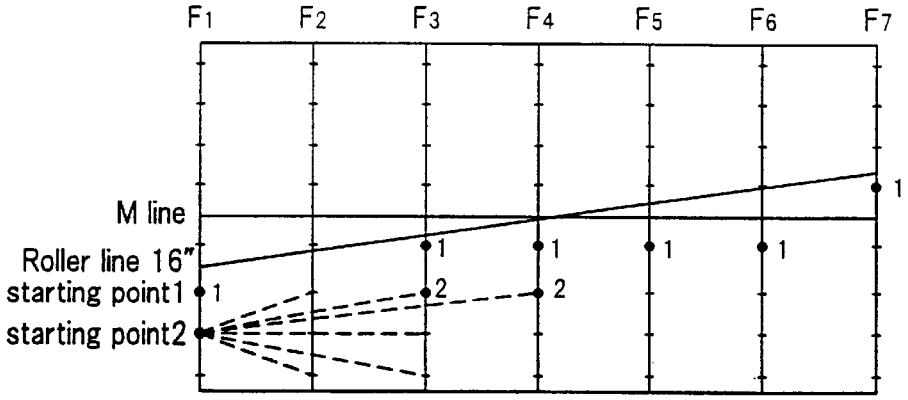
Figure 9C:
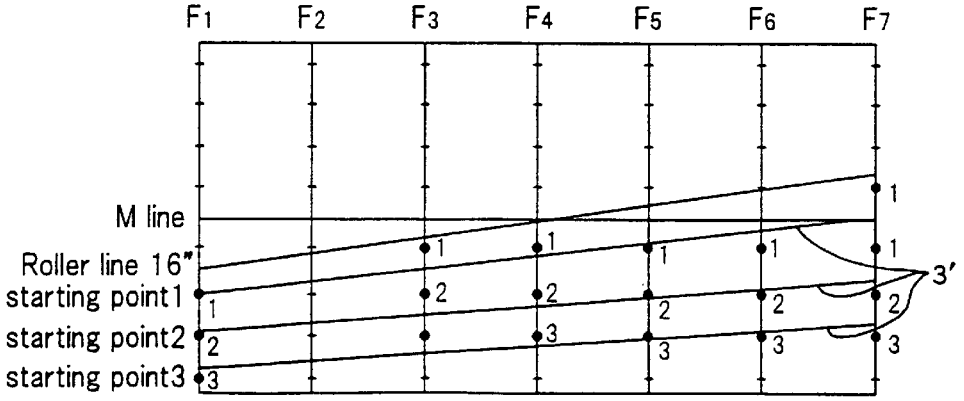

FIGS. 9(*a*), (*b*), (*c*) and (*d*) are explanation drawings for illustrating an example of processing performed by the heating line determining unit 14. Determination of the heating line in this case is performed by connecting the heating points, which have been determined by the heating point determining unit 11, by a virtual straight line, examining the degree of parallelism between this straight line and a virtual roller line 16" drawn on a virtual steel plate 2', and grouping the heating points, whose straight lines show a predetermined degree of parallelism, into the same group. Grouping is performed while dividing the heating points into those above and those below the roller line 16". In FIG. 9, $F_1$ to $F_7$ represent virtual frame lines. The subscripts attached to the symbol F designate the frame line numbers. Many dots indicated narrowly at right angles to the respective frame lines $F_1$ to $F_7$ refer to the heating points.

As shown in FIG. 9(*a*), a starting point 1 is set first of all. From this starting point 1, virtual straight lines (indicated as dashed lines in FIG. 9) are drawn toward the heating points on the respective frame lines $F_1$ to $F_7$. The starting point is established on the frame line of a smaller frame line No. and at a site nearer to the roller line 16".

Then, the degree of parallelism, relative to the roller line 16", of each of the virtual straight lines drawn toward the heating points on the respective frame lines $F_1$ to $F_7$ is examined as stated above. The heating points that give the parallel lines or whose straight lines intersect the roller line 16" at angles not larger than a predetermined angle are grouped together into the same group. FIG. 9(*a*) shows that the heating points of the same group satisfying the requirement for the degree of parallelism based on the starting point 1 are present on the frame lines $F_3$, $F_4$. Upon completion of grouping based on the starting point 1, grouping based on a starting point 2 is performed in accordance with the same procedure, as shown in FIG. 9(*b*). FIG. 9(*b*) shows that the heating points belonging to Group 1 based on the starting point 1 have been fixed, and the heating points based on the starting point 2 are being investigated. On this occasion, the heating points that have already been grouped are neither used as the starting points nor subjected to grouping. In this manner, the heating points lying below the roller line 16" are grouped. After grouping work is completed, a straight line (or a curve) is obtained from the sequence of heating points in each group, as shown in FIG. 9(*c*), and this line is designated as a virtual heating line 3'. The heating line 3' is obtained by the method of least squares if it is a straight line, or by spline interpolation or the like if it is a curve.

Figure 10:
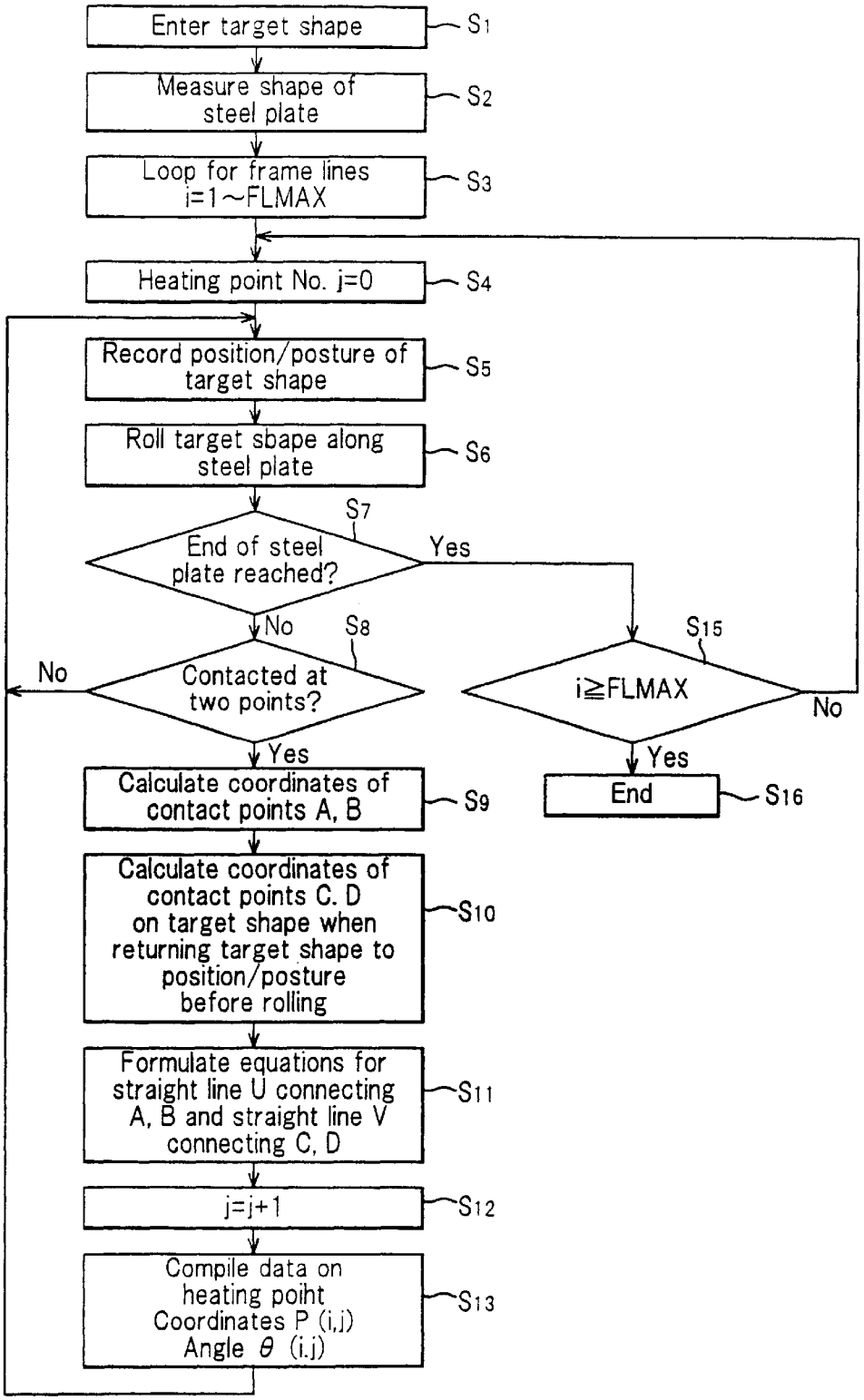
FIG. 10 is a flow chart showing an example for determination of heating points.

FIG. 10 is a flow chart showing a concrete procedure (example) using the heating point determining unit 11 when obtaining the heating points by the contact point finding method. In the instant embodiment, the heating points are obtained on the frame lines, but needless to say, the way of obtaining them is not restricted to this manner. However, the frame lines are lines corresponding to the positions at which frame materials are attached. Thus, data on their positions are stored as design data. The use of the frame lines in obtaining the heating points is advantageous in the applicability of such data. The above-mentioned procedure will be explained based on FIG. 10.

1) Design data such as CAD data are loaded to enter the target shape of the steel plate as three-dimensional data (step $S_1$).
2) The shape of the steel plate, the object to be processed, is measured to obtain three-dimensional coordinate data thereon (step $S_2$). This can be easily performed by an existing measuring method, such as laser measurement or image processing of an image shot with a camera.
3) The processings at step $S_4$ through step $S_{14}$ are performed for the respective frame lines (step $S_3$). The expression "Loop . . . " indicated in the block for step $S_3$ refers to an operation in which the processings subsequent to the step at issue (in this case, step $S_3$) are deemed to be one loop, and the processings belonging to this loop are sequentially repeated for each frame line, as in the instant embodiment (the same will hold later on). At step $S_3$, the frame line No. i is designated as "1", and the flow moves to the processing at a next step $S_4$. "FLMAX" means the maximum frame line No. (the same will hold later on).
4) Since no heating point exists initially, j=0 is set as the initial value of the heating point No. (step $S_4$).
5) The position and posture of the target shape are recorded (step $S_5$). Concretely, records are made, for example, of the coordinates of the reference point of the target shape (the point of intersection between a curve of the frame line showing the target shape and a sight line, i.e., the point of the virtual wooden pattern showing the M line), and the inclination of the sight line (the inclination angle based on the horizontal line or the vertical line). The state on this occasion corresponds to the initial state in which during an operation using a conventional wooden pattern, an operator places the middle point of a portion of the wooden pattern extending along the target shape on the M line of the steel plate, and holds the sight line vertically.
6) The target shape is rolled along the steel plate (step $S_6$), and its rolling is repeated until the target shape reaches the end of the steel plate (step $S_7$). When the target shape and the steel plate are detected to have contacted at 2 points during the rolling ($S_8$), the processing described in the aforementioned "principle of the contact point finding method" is performed to determine the coordinates of the intersection point P and its angle θ (steps $S_9$, $S_{10}$, $S_{11}$ and $S_{12}$).
7) "1" is added to the heating point No., and data on the respective heating points on specific frame lines are compiled (steps $S_{13}$ and $S_{14}$). These data on the heating points are given as three-dimensional coordinate and angle data with the respective frame line Nos. and the respective heating point Nos. specified.
8) When it is detected at the judging step (step $S_7$) that the end of the steel plate has been reached, it is judged whether the frame line No. at this time is larger than the maximum value of the number of the frame lines (FLMAX) for which the heating point determining processings are performed. If the frame line No. i<FLMAX, the processings at steps $S_4$ to $S_{14}$ are repeated for the frame line of the next No. Whenever the flow returns to step $S_4$, "1" is added to the frame line No. i. If the frame line No. i≧FLMAX, this means that the predetermined processings for obtaining the heating points have been completed for all the frame lines. Thus, the heating point determining processings are ended (steps $S_{15}$ and $S_{16}$).
9) When it is not detected by the processing at step $S_8$ that no contact at 2 points has been made, the flow returns to the processing at step $S_5$, and the processing at steps $S_5$ to $S_7$ are repeated. That is, the target shape is rolled at a certain angle by a single processing, and the processings at steps $S_5$ to $S_7$ are repeated until contact at 2 points is detected. Thus, if the shape of the steel plate extending along the frame line for which the heating points are to be determined is a flat plane, it is detected by the processing at step $S_7$ that the end of the steel plate has been reached with no contact point being determined. Thus, a judgment is made that no heating point exists for this frame line, and the flow moves to the processing for the next frame line. If no contact at 2 points has been detected for all the frame lines, namely, if the entire steel plate is of a flat shape, no heating points can be determined by the "contact point finding method". Thus, the steel plate for which heating points should be determined by this method must have been subjected to primary bending with a bending roll or the like.

According to the processing at step $S_6$, the target shape is rolled along the steel plate, but the same effect is obtained if the steel plate is rolled along the target shape. In short, one of them may be rolled relative to the other so that the contact point of the two is obtained. The purpose of determining the heating points in the above manner is to obtain the heating positions and heating intensities (quantities of heat given to the steel plate) for causing the necessary change in shape. Between the heating intensity and the angle θ, there is a predetermined relationship, which can be found experimentally. Thus, at a time when the angle θ is found, the heating intensity can be determined (needles to say, if the angle θ is recorded as data, it can be converted to the heating intensity later, where necessary). Thus, at step $S_{14}$, the heating intensity with respect to the angle θ may be obtained along with data on the angle θ, although this is not directly related to the processing for finding the heating point.

Figure 11:
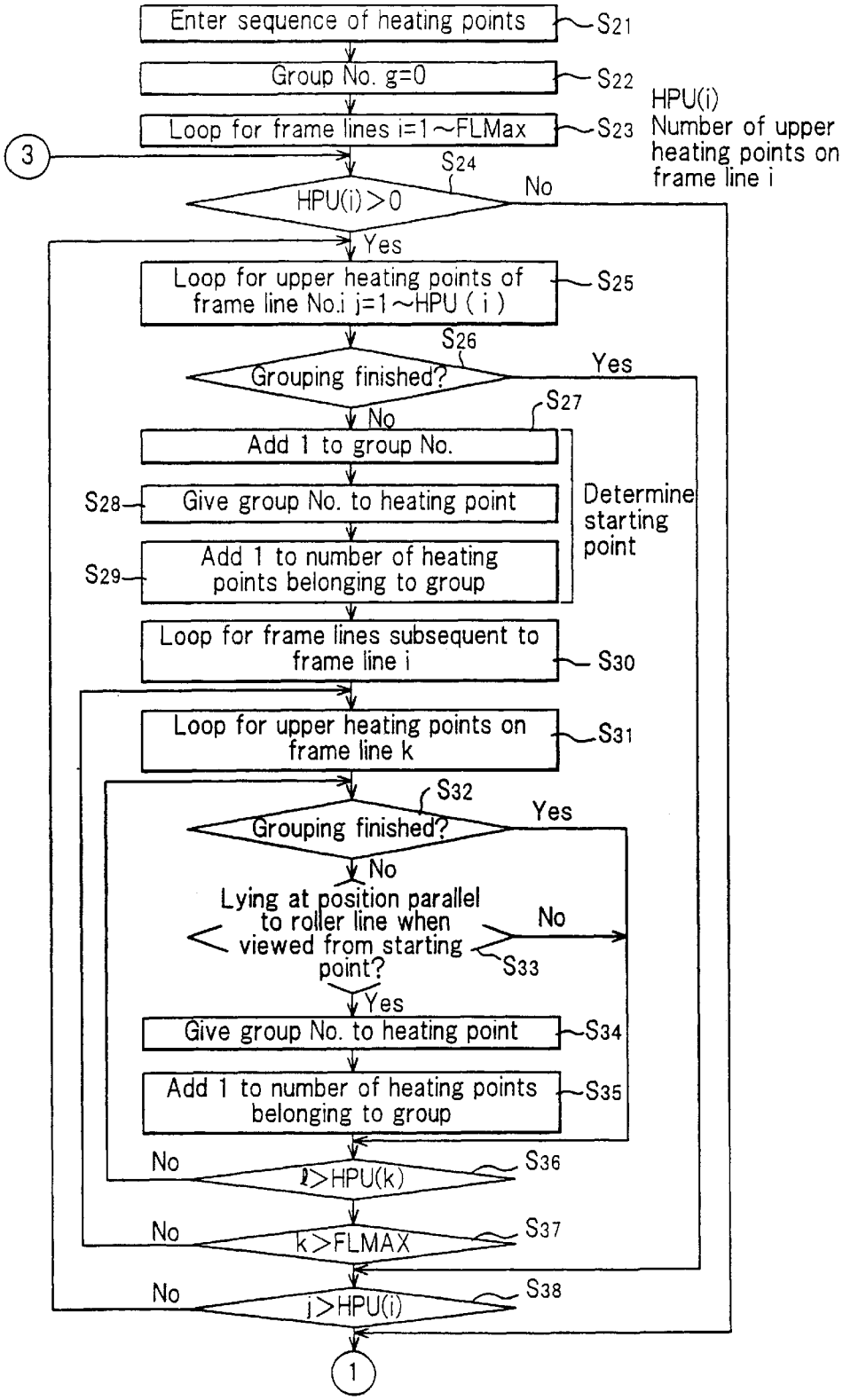
FIG. 11 is a flow chart 1 showing a first example for determination of heating lines.
Figure 12:
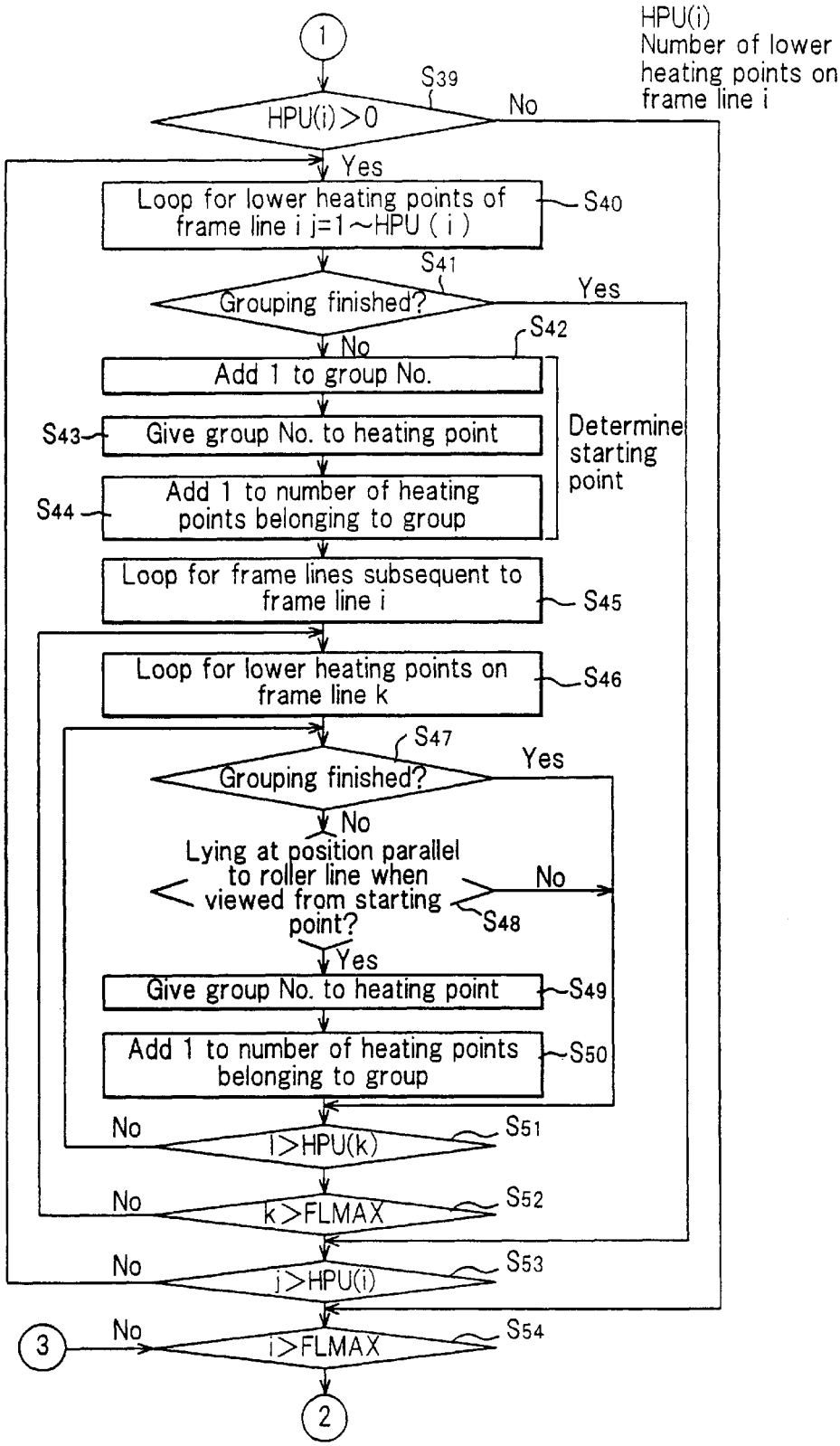
FIG. 12 is a flow chart 2 showing the first example for determination of heating lines.
Figure 13:
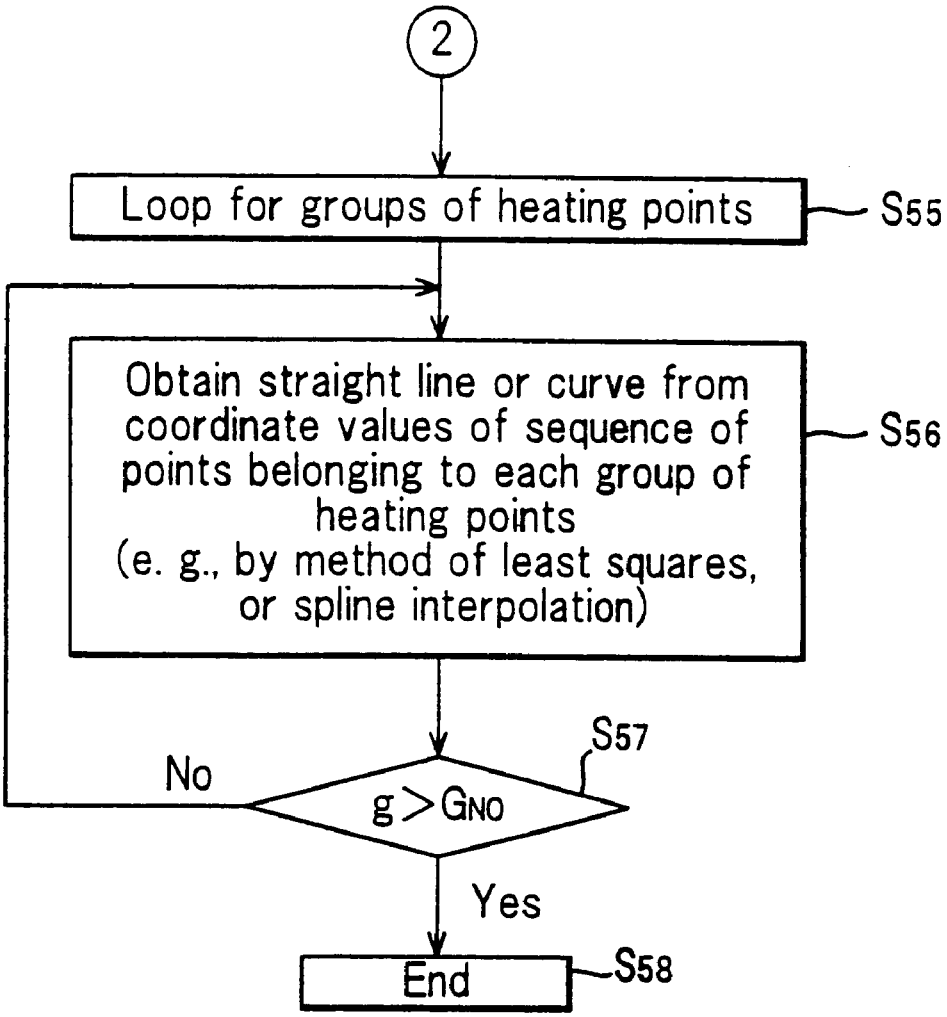
FIG. 13 is a flow chart 3 showing the first example for determination of heating lines.

FIGS. 11 to 13 are flow charts showing a concrete procedure (example) using the heating line determining unit 14 when obtaining the heating lines on the basis of the heating points determined. This procedure will be explained based on these drawings.

The following processings are performed as shown in FIG. 11:

1) Data on the heating points are entered (step $S_{21}$). Concretely, entry is made of the three-dimensional coordinate and angle data on the respective heating points on the respective frame lines that have been obtained at step $S_{14}$ of FIG. 10.
2) Since no predetermined group is formed initially, g=0 is set as the initial value of the group No. g (step $S_{22}$).
3) The processings at steps $S_{24}$ to $S_{54}$ are performed for the respective frame lines (step $S_{23}$).
4) It is judged whether the number of the upper heating points on the frame line of the frame line No. i is HPU(i)>0 (step $S_{24}$). "The number of the upper heating points, HPU" means the number of the heating points above the roller line 16" found when it is determined whether the heating point is above or below the roller line 16". For example, the heating point with a larger Y coordinate than that of the point of intersection of each frame line and the roller line 16" is regarded as the upper heating point. Thus, if the upper heating point exists, HPU(i)>0. In this case, the flow moves to the processing at step $S_{25}$.
5) The processings at steps $S_{26}$ to $S_{38}$ are performed for the respective upper heating points on the frame line of the frame line No. i (step $S_{25}$). That is, the same processings are carried out for the respective heating points of the heating point Nos. j=1~HPU(i) to perform their grouping.
6) It is judged whether grouping is finished or not (step $S_{26}$). Concretely, it is judged whether the group No. g is assigned to the heating points that are being judged.
7) When the judgment at step $S_{26}$ shows that the heating points, the objects being judged, have not been grouped, "1" is added to the group No. g (step $S_{27}$). Since the initial value of the group No. g is "0", the group No. g=1 is given at the processing for the first heating point concerned with the first frame line.
8) The heating point, the object being processed, is given the group No. g assigned at step $S_{27}$ (step $S_{28}$).
9) The number of the heating points belonging to the group is designated as "1" (step $S_{29}$).
10) A starting point is determined by the processings at steps $S_{27}$ to $S_{29}$.
11) The processings at steps $S_{31}$ to $S_{37}$ are performed for the respective frame lines of the frame line Nos. i later than the frame line No. i (step $S_{30}$). These frame line Nos. are k=(i+1)~FLMAX.
12) The processings at steps $S_{32}$ to $S_{36}$ are performed for the respective upper heating points on the frame line of the frame line No. k (step $S_{31}$).
13) It is judged whether grouping of the specific heating points on the frame line of the frame line No. k is finished or not (step $S_{32}$). Concretely, it is judged whether the group No. g is assigned to the heating point being judged.
14) When the judgment at step $S_{32}$ shows that the heating point being judged has not been grouped, it is judged whether this heating point is at a position parallel to the roller line 16" when viewed from the starting point (step $S_{33}$). For example, the heating point as the starting point and the heating point as the object being judged are connected together by a straight line, and the angle of this straight line to the roller line 16" is detected. If this angle is less than a predetermined value, a judgment is made that the heating point in question is at a parallel position. Alternatively, the same judgment can be made by measuring the distance between each end of the straight line and the roller line 16", and detecting whether the distances measured are each within a certain range.
15) When the judgment at step $S_{33}$ shows that the heating point being judged lies at a position parallel to the roller line 16", this heating point is assigned the same group No. g as that of the heating point as the starting point (step $S_{34}$).
16) "1" is added to the number of the heating points of the group No. g assigned at step $S_{34}$ (step $S_{35}$).
17) When the processing at step $S_{35}$ is completed, or when grouping of the heating points being judged by the processing at step $S_{32}$ is completed, or when the absence of a predetermined degree of parallelism is detected by the processing at step $S_{33}$, the processings at steps $S_{32}$ to $S_{35}$ are repeated (step $S_{36}$) until the heating point No. l of the heating point being judged as belonging to the frame line of the frame line No. k becomes larger than the maximum value HPU (k). Whenever the flow returns from step $S_{36}$ to step $S_{32}$, "1" is added to the heating point No. In this manner, grouping of the heating points on the specific frame line is performed.
18) When it is detected by the processing at step $S_{36}$ that grouping of all the upper heating points on the frame line of the frame line No. k is completed, the processings at steps $S_{31}$ to $S_{36}$ are repeated until the frame line No. k becomes larger than the maximum value FLMAX (step $S_{37}$). Whenever the flow returns from step $S_{37}$ to step $S_{31}$, "1" is added to the frame No. k. In this manner, grouping of the upper heating points for all the frame lines of the frame line Nos. later than i is performed.
19) When it is judged by the processing at step $S_{26}$ that grouping of the heating points, the objects being judged, on the frame line of the frame line No. i has been finished, or when it is detected by the processing at step $S_{37}$ that grouping of the upper heating points for all the frame lines of the frame line Nos. later than i has been finished, the processings at steps $S_{26}$ to $S_{38}$ are repeated (step $S_{38}$) until the heating point No. j of the heating point being judged as belonging to the frame line of the frame line No. i becomes larger than the maximum value HPU(i). Whenever the flow returns from step $S_{38}$ to step $S_{26}$, "1" is added to the heating point No. In this manner, grouping of the upper heating points on the frame line of the frame line No. i is performed.

As shown in FIG. 12, the following processings are performed:

20) When it is detected by the processing at step $S_{24}$ that no upper heating points exist on the frame line of the frame line No. i, or when it is detected by the processing at step $S_{38}$ that grouping of all the upper heating points on the frame line where the starting point belongs is completed, grouping of the lower heating points on each frame line is performed by exactly the same procedure. That is, the processings at steps $S_{39}$ to $S_{53}$ corresponding to the processings at steps $S_{24}$ to $S_{38}$ are performed for the lower heating points. At step $S_{39}$, "the number of the lower heating points, HPL" refers to the number of the heating points that is in contrast to the upper heating points when it is determined whether the heating point is above or below the roller line 16". In other words, HPL means the number of the heating points below the roller line 16". For example, the heating point with a smaller Y coordinate than that of the point of intersection of each frame line and the roller line 16" is regarded as the lower heating point.

21) When it is detected by the processing at step $S_{39}$ that no lower heating points exist on the frame line of the frame line No. i, or when it is detected by the processing at step $S_{53}$ that grouping of all the lower heating points on the frame line where the starting point belongs is completed, it is judged whether the frame line No. is larger than FLMAX. If it is smaller, the processings at steps $S_{24}$ to $S_{53}$ are repeated for each frame line. When these processings are completed for all the frame lines, i.e., when grouping of all the heating points belonging to all the frame lines is completed, the flow moves to the next processing (step $S_{54}$).

As shown in FIG. 13, the following processings are performed:

22) For each heating point group established, the heating points of each group are sequentially connected together by a straight line, or a straight line or a curve is calculated by the method of least squares, spline interpolation or the like based on the coordinate values of the heating points, thereby to obtain a heating line (steps $S_{55}$ and $S_{56}$). At step $S_{55}$, "$G_{NO}$" refers to the maximum value of the number of the groups.

23) When it is detected that the group No. $\geqq G_{NO}$, i.e., when it is detected that the heating lines 3 have been determined for all the groups, all the processings are completed (steps $S_{57}$ and $S_{58}$).

Figure 14:
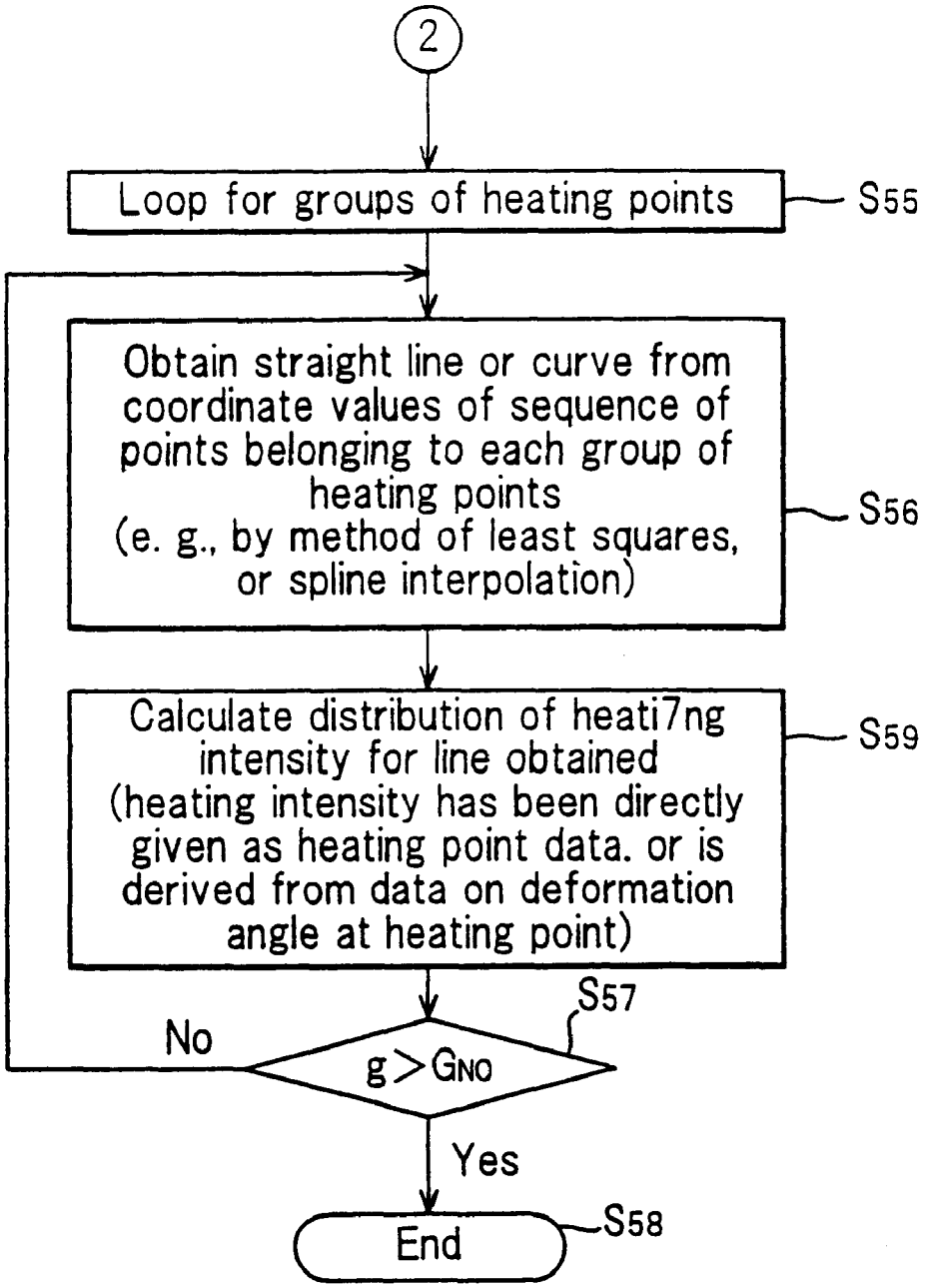
FIG. 14 is a flow chart showing part of a second example for determination of heating lines.

FIG. 14 shows an example in which the heating intensity (determined by the bending angle θ) at each heating point is taken into consideration during the processings illustrated in FIG. 13, and the information on the heating intensity is incorporated into the information on the heating line. As shown in FIG. 14, the distribution of the heating intensity is calculated for the determined heating line by the process subsequent to step $S_{56}$ in accordance with the instant embodiment (step $S_{59}$). The heating intensity has been directly obtained separately based on the bending angle θ at the heating point, or is determined on the basis of information on the bending angle θ at the heating point.

According to the instant embodiment, the heating points on each heating line 3 can be heated with the most appropriate quantity of heat. In the case of bending by high frequency heating, for example, this can be easily achieved by controlling an electric current supplied to the high frequency heating coil to control the amount of heat input to the steel plate 2.

Figure 15:
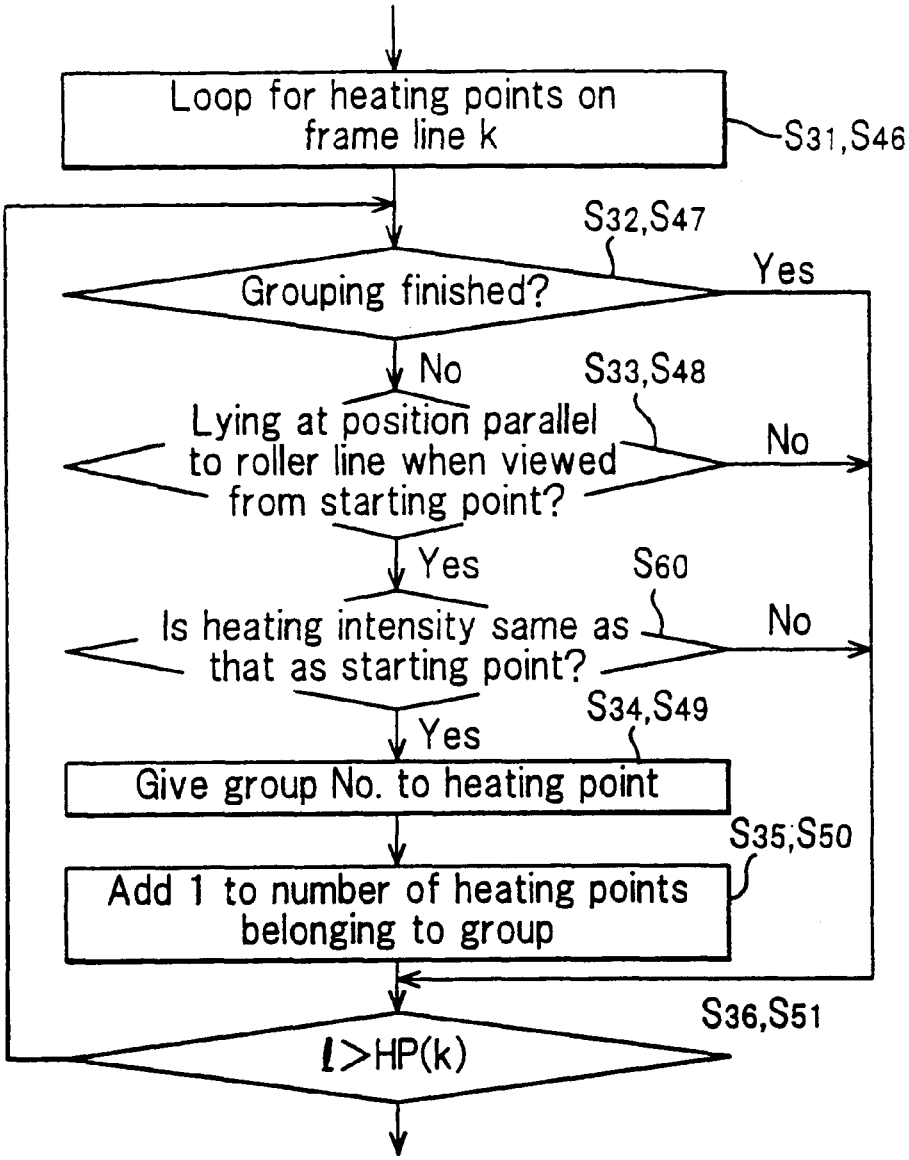
FIG. 15 is a flow chart showing part of a third example for determination of heating lines.

FIG. 15 shows an example in which the heating intensity (determined by the bending angle θ) at each heating point is taken into consideration during the processings illustrated in FIGS. 11 and 12, and this heating intensity is also incorporated into the conditions for grouping. As shown in FIG. 15, in accordance with the instant embodiment, it is judged by the processing subsequent to step $S_{33}$ or step $S_{48}$ whether the heating intensity is same as the heating intensity at the starting point (the heating intensity includes that within a predetermined tolerance range) (step $S_{60}$). If this judgment shows that the heating point in question does not have the same heating intensity, this heating point is excluded from the relevant group. In other words, the same group No. as that of the starting point is assigned to the heating point, provided that it has the same heating intensity.

According to the instant embodiment, the heating points on each heating line 3 can be heated with the same quantity of heat. In the case of bending by high frequency heating, for example, the most appropriate amount of heat input to the steel plate can be given by keeping the electric current supplied to the high frequency heating coil constant for a single heating line 3.

In the above-described embodiments, the term "virtual" has been defined as not existing as a real one, but existing as electronic data or a graphic expressed in a visible form on the display unit 16. However, such a restriction need not be applied to the technical idea of the present invention. A wooden pattern and a steel plate which an operator prepares by plotting are also included in the concept "virtual" as referred to herein, unless they are real ones.

Figure 16:
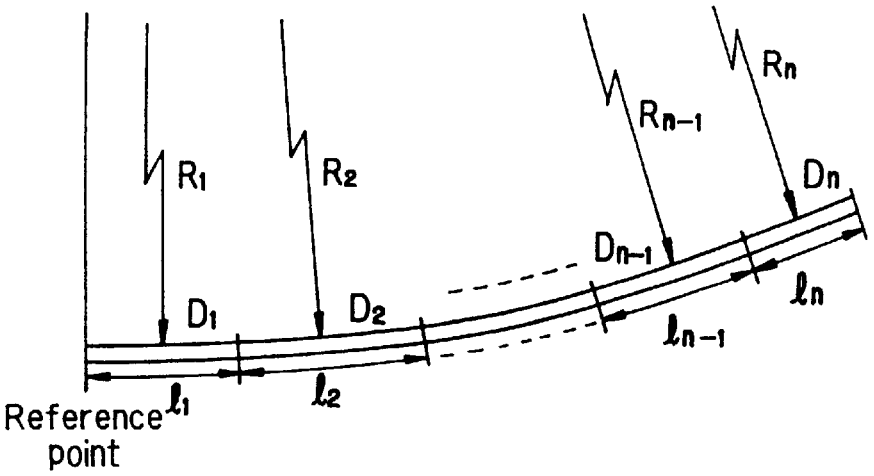
FIG. 16 is an explanation drawing for illustrating the principle of a curvature comparison method which is processing performed by the heating point determining unit 11 in FIG. 5 (a state in which the curve of a target shape is divided into fine zones that constitute arcs with radii of $R_1$ to $R_n$)
Figure 17:
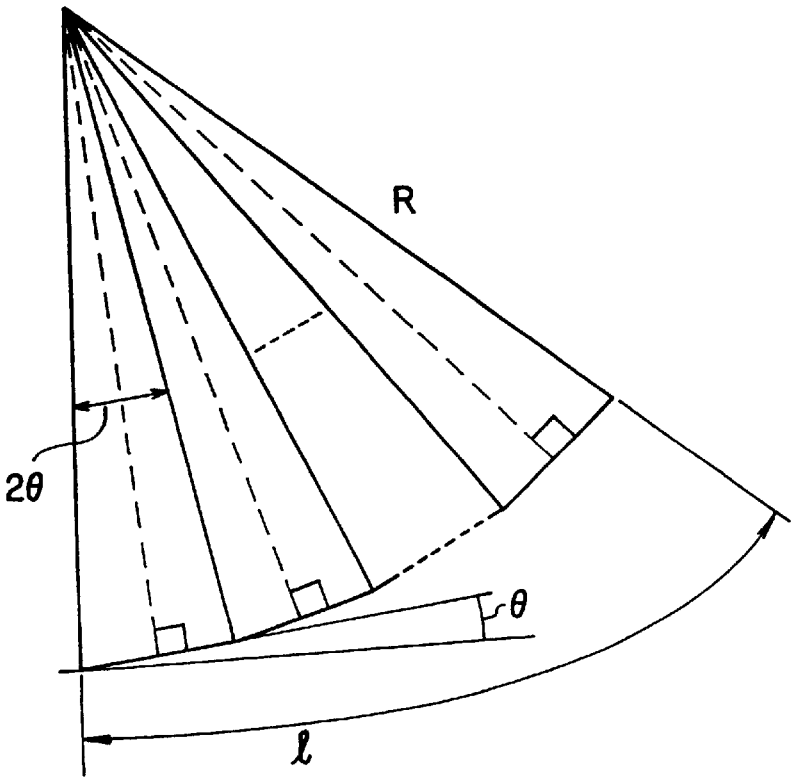
FIG. 17 is an explanation drawing for illustrating the principle of the curvature comparison method which is processing performed by the heating point determining unit 11 in FIG. 5 (a state in which one of the arcs of FIG. 22 is approximated by a fold line defined by the bases of a plurality of isosceles triangles connected together while sharing their equal sides)
Figure 18:
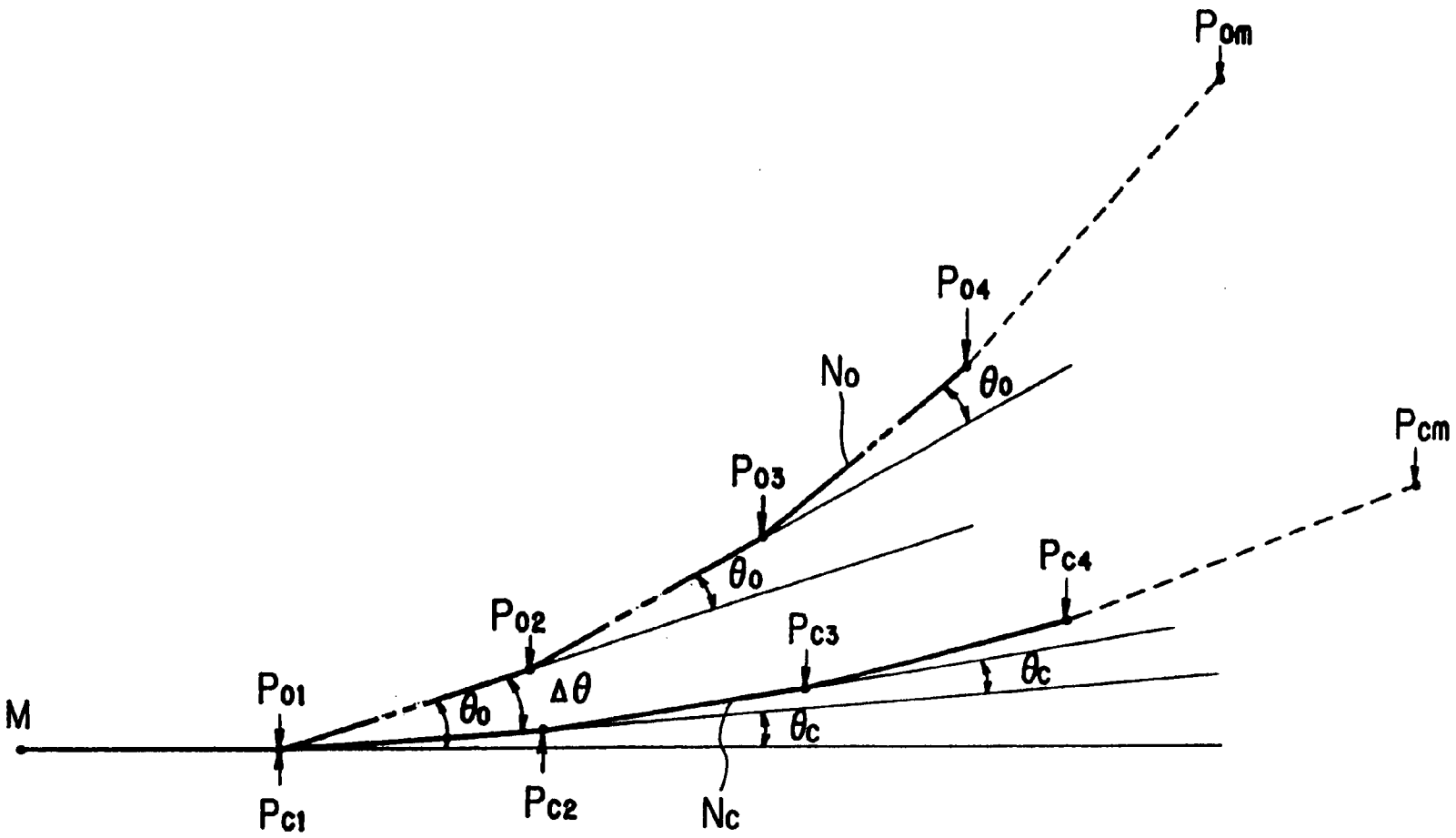
FIG. 18 is an explanation drawing for illustrating the principle of the curvature comparison method which is processing performed by the heating point determining unit 11 in FIG. 5 (a comparison between the target shape and the measured shape when approximated by fold lines defined by the bases of a plurality of isosceles triangles)

FIGS. 16 to 18 are explanation drawings for illustrating another example of processing performed by the heating point determining unit 41. The processing shown in these drawings focuses on the fact that the curved shape of the steel plate 2 on a predetermined line, such as each frame line, can be regarded as a collection of arcs with a plurality of curvatures. The arc of the target shape is compared with the arc of an actually measured shape corresponding to this arc portion on the basis of the curvatures of both arcs. Based on the results of comparison, the heating point is determined. This method is called "the curvature comparison method".

FIGS. 16 and 17 are views for illustrating the principle of the curvature comparison method. FIG. 16 shows the curve of the target shape (only its half to the right of M line, the reference line, is shown) divided into fine segments $D_l$ to $D_n$ which are arcs with radii of $R_1$ to $R_n$. Whereas FIG. 17 shows a mode in which one of the divisional arcs indicated in FIG. 16 is approximated by a fold line defined by the bases of a plurality of (number m in FIG. 17) congruent isosceles triangles connected together while sharing their equal sides. As shown in FIG. 16, the target shape is divided into a plurality of fine segments $D_l$ to $D_n$, these fine segments $D_l$ to $D_n$ are regarded as arcs, curvatures or radii are designated for the respective segments $D_l$ to $D_n$, and the lengths $l_l$ to $l_n$ of the arcs of the respective segments $D_{l\ to\ Dn}$ are designated, whereby the target shape can be specified. Thus, if the target shape data 12 in the respective segments $D_l$ to $D_n$ are compared with the steel plate measurement data 13, the amount of deformation of the steel plate 2 for making the target shape and the shape of the steel plate agree can be determined by the difference between the two types of data. Here, the deformation in heat bending is bending at the heating points. That is, the arcs in the respective fine segments are approximated by straight lines.

As shown in FIG. 17, when an arc with radius R is approximated by the fold line defined by the bases of the m number of the isosceles triangles connected together while sharing their equal sides, the length 1 of the arc is generally given by the equation (1):

$$L=2\theta\cdot R\cdot m \tag{1}$$

In the equation (1), θ is the angle between the bases of the isosceles triangles.

FIG. 18 is an explanation drawing showing by a two-dot chain line a mode in which the arc of one segment of the target shape is approximated by a fold line $N_O$ defined by the bases of the m number of isosceles triangles connected together while sharing their equal sides, and showing by a solid line a mode in which the arc of one segment of the measured shape corresponding to this segment is approximated by a fold line $N_C$ defined by the bases of the m number of isosceles triangles connected together while sharing their equal sides. As shown in FIG. 18, straight lines connecting the points ($P_{O1}$, $P_{O2}$), ($P_{O2}$, $P_{O3}$) , ($P_{O3}$, $P_{O4}$) . . . make the fold line $N_O$, while straight lines connecting the points ($P_{C1}$, $P_{C2}$), ($P_{C2}$, $P_{C3}$), ($P_{C3}$, $P_{C4}$) . . . make the fold line $N_C$. $\theta_O$ is the angle that each subline of the fold line $N_O$ forms with the adjacent subline, while $\theta_C$ is the angle that each subline of the fold line $N_C$ forms with the adjacent subline. Referring to FIG. 18, one will see that when each subline of the fold line based on the measured shape indicated by the solid line is bent by Δθ (=$\theta_O$−$\theta_C$) it coincides with each subline of the fold line based on the target shape.

Let the length of the segment of the target shape and the measured shape of the steel plate 2 to be compared be $l_O$, and the radius of the arc of the target shape in this segment be $R_O$. When this arc is approximated by the fold line $N_O$ defined by the bases of the m number of isosceles triangles connected together while sharing their equal sides, the relation of the equation (2) is obtained from the equation (1):

$$l_O=2\theta_O \cdot R_O \cdot m \tag{2}$$

On the other hand, let the radius of the arc based on the measured shape of the portion corresponding to the segment to be compared be $R_C$. When this arc is approximated by the fold line $N_C$ defined by the bases of the m number of isosceles triangles connected together while sharing their equal sides, the relation of the equation (3) is obtained from the equation (1):

$$l_C=2\theta_C \cdot R_C \cdot m \tag{3}$$

To heat-process the measured shape into the target shape, it is necessary to bend the m number of sublines of the fold line $N_C$ for the measured shape in the manner stated earlier. When the bending angle at this time is designated as Δθ, the bending angle Δθ is given as the difference between the angle formed by the adjacent sublines of the fold line $N_O$ and the angle formed by the adjacent sublines of the fold line $N_C$. That is, the bending angle Δθ is expressed by the equation (4):

$$\begin{aligned}\Delta\theta = \theta_o - \theta_c &= (l_0/2R_0 \cdot m) - (l_0/2R_c \cdot m) \\ &= \{l_0(R_c - R_0)\}/(2 \cdot R_0 \cdot R_c \cdot m)\end{aligned} \tag{4}$$

Here, the lengths of the fold lines to be compared are equal, so that $l_O$32 $l_C$ In heating of a single steel plate 2, its efficiency is high when the amount of heating (e.g., the amount of heat input based on parameters such as an electric current, and the clearance between a high frequency heating coil and the steel plate 2, during high frequency heating) is made constant overall. When the amount of heating is constant, the bending angle Δθ is derived from the properties (material, thickness, etc.) of the steel plate 2. That is, a predetermined bending angle Δθ is determined by determining the desired amount of heating, and the number m of the sublines of each of the fold lines $N_O$ and $N_C$ is given by the equation (5):

$$m=\{l_O(R_C R_O)\}/(2 \cdot R_O \cdot R_C \cdot \Delta\theta) \tag{5}$$

This means that if the bending angle Δθ is given, it suffices to divide the length $l_C$ by the number m calculated from the equation (5). In other words, the heating points are obtained as respective positions found when the length $l_C$ is divided by the heating distance ($l_C$/m) That is, if the radius $R_O$ of the arc of the target shape, the radius $R_C$ of the arc of the measured shape corresponding thereto, the length $l_O$ (length of the segment to be compared) of both arcs, and the bending angle Δθ are given, then the three-dimensional positional coordinates of the corresponding heating points can be sought as solutions to geometrical problems by computations.

In case the steel plate 2 is a flat plate, on the other hand, the radius $R_C$ in the equation (5) becomes infinity, so that m cannot be obtained. Thus, the equation (5) is converted into the equation (6):

$$\begin{aligned}m &= \{l_0(R_c - R_0)\}/(2 \cdot R_0 \cdot R_c \cdot \Delta\theta) \\ &= \{l_0(1 - R_0/R_c)\}/(2 \cdot R_0 \cdot \Delta\theta)\end{aligned} \tag{6}$$

Infinitizing $R_C$ in the equation (6) makes ($R_O$/$R_C$) zero, thus giving the equation (7):

$$m=l_O/(2 \cdot R_O \cdot \Delta\theta) \tag{7}$$

The equation (7) is equal to calculating the number m of isosceles triangles for the length $l_O$ of the arc in the isosceles triangles which inscribe in the target shape with radius $R_O$ and whose adjacent bases form the angle Δθ. In short, when a flat plate is bent, the heating distance can be found from the radius $R_O$ of the target shape and the bending angle Δθ.

To determine the heating points by the above-described curvature comparison method, the heating point determining unit 11 prepares the following data on the basis of the target shape data 12 read in: ① position data on the reference line on each frame line, ② position data on the end of the steel plate 2 as the object to be processed, ③ curvature data on the arc in each segment when the curved shape of the steel plate 2 on each frame line is regarded as a collection of arcs with a plurality of curvatures, and ④ position data on the point of the boundary between each segment and the adjacent segment. The curvature data ③ are values designated at the time of designing, or if these values are not designated, the data are calculated using the point sequence data of the target shape data 12. Similarly, data corresponding to ① to ④ are compiled from the steel plate shape measurement data 13 as well. At this time, the data ③ correspond to the respective segments of the target shape.

The heating point determining unit 11 processes the data ① to ④ on the target shape and the measured shape, and calculates the heating points by the curvature comparison method described based on FIGS. 16 to 18. An example of the relevant concrete procedure will be explained by reference to FIGS. 19 to 22. FIGS. 19 to 22 are flow charts showing this example. In this example, the heating points are obtained on the frame lines, but needless to say, the way of obtaining them is not restricted to this manner. However, the frame lines are lines corresponding to the positions at which frame materials are attached. Thus, data on their positions are stored as design data. The use of the frame lines in obtaining the heating points is advantageous in the applicability of such data.

Figure 19:
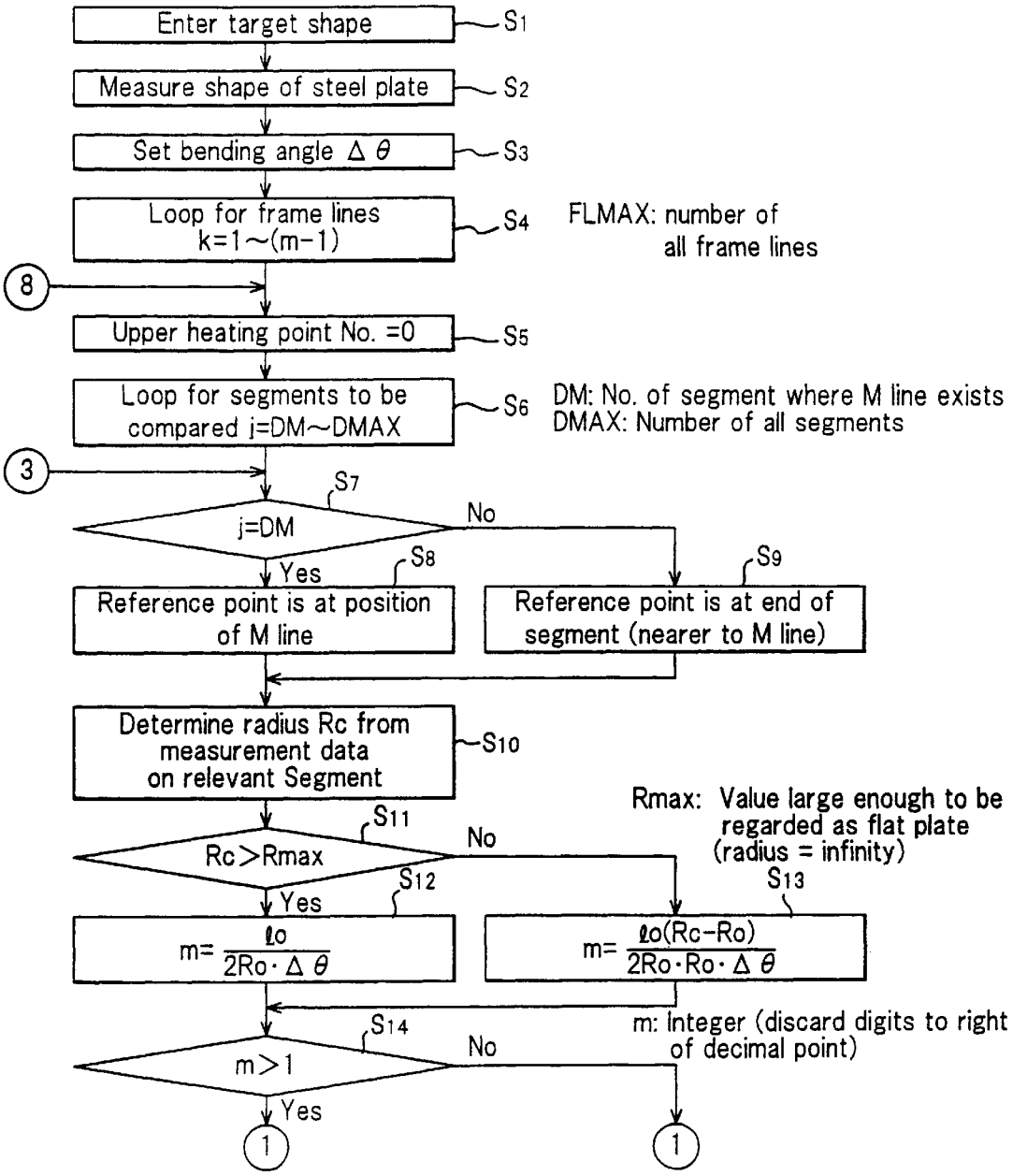
FIG. 19 is a flow chart 1 showing a further example for determination of heating points.

As shown in FIG. 19, the following processings are performed:

1) Design data such as CAD data are loaded to enter the target shape of the steel plate as three-dimensional data, and processings are also performed for the preparation of the data ① to ④, such as curvature data on the arc in each segment constituting each frame line, and position data on the point of the boundary between each segment and the adjacent segment (step $S_1$).
2) The shape of the steel plate 2, the object to be processed, is measured to obtain three-dimensional coordinate data thereon, and processings are also performed for the preparation of the data ① to ④ as for the target shape (Step $S_2$). Measurement of the shape of the steel plate 2 can be easily performed by an existing measuring method, such as laser measurement or image processing of an image shot with a camera.
3) The bending angle $\Delta\theta$, a heat deforming angle, is set (step $S_3$).
4) The processings at step $S_5$ through step $S_{41}$ are performed for the respective frame lines (step $S_4$). The expression "Loop . . . " indicated in the block for step $S_4$ refers to an operation in which the processings at steps subsequent to the step at issue (in this case, step $S_4$) are regarded as one loop, and the processings belonging to this loop are sequentially repeated for each frame line, as in the instant embodiment (the same will hold later on) At step $S_4$, the frame line No. i is designated as "1", and the flow moves to the processing at a next step $S_5$. "FLMAX" means the maximum frame line No. (the same will hold later on).
5) Since no upper heating point exists initially, "0" is set as the initial value of the heating point No. (step $S_5$). "The upper heating point" means the heating point above a reference line, a straight line heading in the direction of a central axis of a cylinder whose part is deemed to approximate the target shape of the steel plate 2 (e.g., a point above the roller reference line 16' used in the explanation of a heating line determination method to be detailed later based on FIG. 8) when it is determined whether the heating point is above or below the reference line. For example, the heating point with a larger Y coordinate than that of a point on the reference line is regarded as the upper heating point.
6) The processings at step $S_7$ to step $S_{22}$ are performed for the respective segments, DM to DMAX, to be compared (step $S_6$). "DM" denotes the No. of the segment where the M line, the initial reference position, exists. "DMAX" designates the maximum value of the segment No.
7) It is judged whether the segment is the segment where the M line, the initial reference position, exists (step $S_7$).
8) If the processing at step $S_7$ shows it to be the segment where the M line exists, a judgment is made that the reference point is at the position of the M line. Based on this judgment, this position is set (step $S_8$).
9) If the processing at step $S_7$ shows it to be the segment where no M line exists, a judgment is made that the reference point is at the end of the segment nearer to the M line. Based on this judgment, this position is set (step $S_9$).
10) The radius Rc is found from the measurement data on the relevant segment (step $S_{10}$).
11) It is judged whether $R_C$ is larger than the radius $R_{max}$ (step $S_{11}$). The radius $R_{max}$ has been set at a value large enough for the steel plate to be regarded as a flat plate (radius=infinity).
12) If the processing at step $S_{11}$ shows $R_C > R_{max}$, the steel plate 2 as the object to be processed is deemed to be a flat plate. Thus, a calculation based on the equation (8) is done to determine the number m of the sublines of a fold line belonging to the relevant segment (step $S_{12}$).
13) If the processing at step $S_{11}$ shows $R_C \leqq R_{max}$, a calculation based on the equation (7) is made to determine the number m of the sublines of a fold line belonging to the relevant segment (step $S_{13}$) The value of m is treated such that the digits to the right of the decimal point are discarded to give an integer.
14) It is judged whether the number m of the sublines is larger than 1 (step $S_{14}$).

Figure 20:
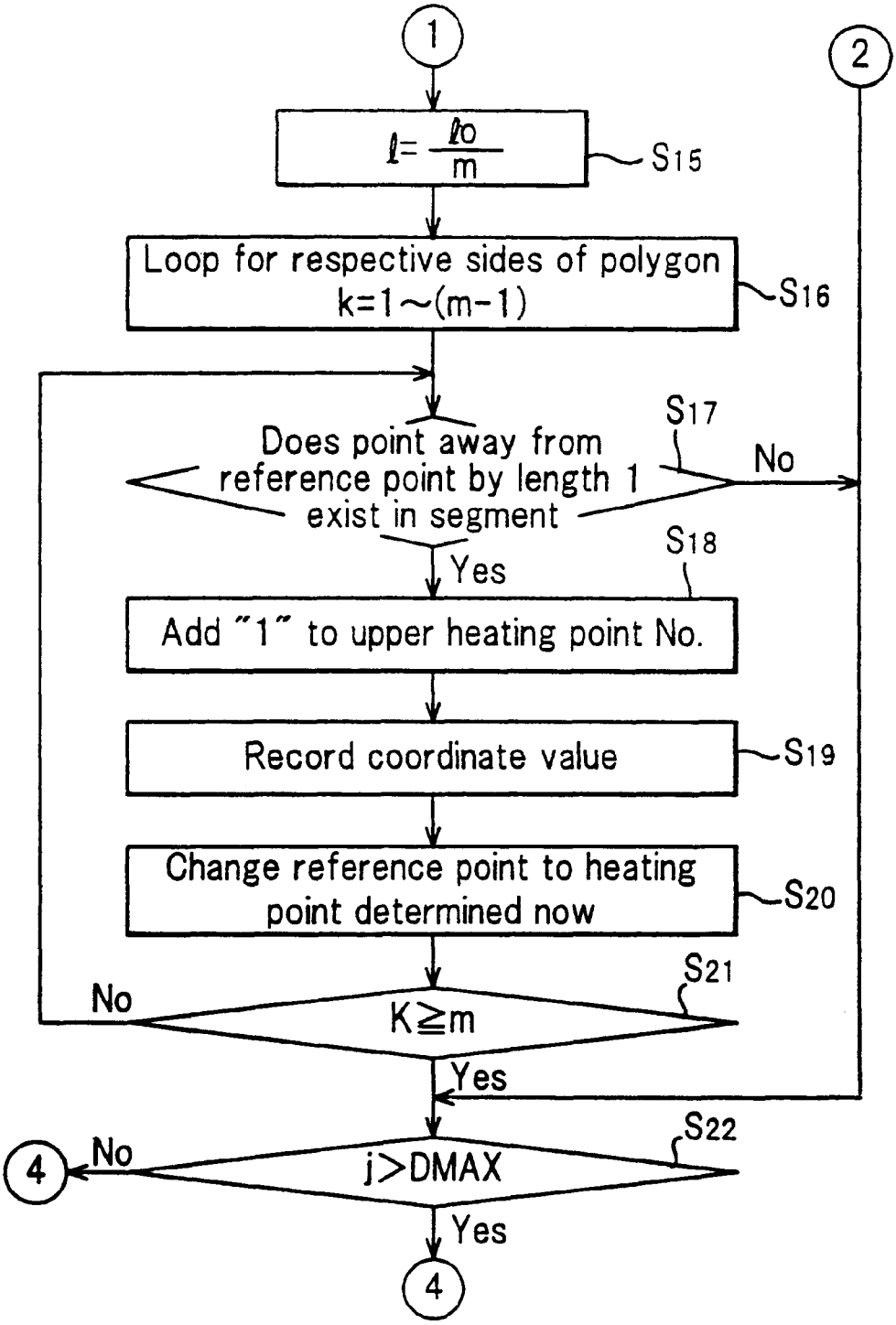
FIG. 20 is a flow chart 2 showing the further example for determination of heating points.

As shown in FIG. 20, the following processings are performed:

15) If the processing at step $S_{14}$ shows m>1, the length l of the heating distance ($l=l_O/m$) is calculated (step $S_{15}$). If $m \leqq 1$, this means that two or more sublines are not present in the relevant segment, and there is no apex which should serve as the position of bending. Thus, the procedure moves to the processing for a next segment.
16) The processings at steps $S_{17}$ through $S_{21}$ are performed for the respective sublines of the fold line belonging to the relevant segment (step $S_{16}$).
17) It is judged whether a point apart from the reference point in the relevant segment by the length l of the heating distance exists in this segment (step $S_{17}$).
18) If the processing at step $S_{17}$ shows the existence of such a point in the segment, "1" is added to the upper heating point No. (step $S_{18}$). If that processing shows the absence of such a point, the flow moves to the processing for a next segment.
19) In addition to the upper heating point No. associated with the processing at step $S_{18}$, the coordinate value of this heating point is recorded (step $S_{19}$).
20) The reference point is changed to the heating point determined at step $S_{19}$ (step $S_{20}$).
21) The processings at steps $S_{17}$ through $S_{20}$ are repeated until the No. of the subline belonging to the segment becomes $k \geqq m$ (step $S_{21}$). Each time the flow returns from step $S_{21}$ to the processing at step $S_{17}$, "1" is added to the subline No. k.
22) If the processing at step $S_{21}$ shows $k \geqq m$, if the processing at step $S_{17}$ shows the absence of a predetermined point in the segment, or if the processing at step $S_{14}$ shows $m \leqq 1$, the processings at steps $S_7$ through $S_{21}$ are repeated until the segment No. becomes j>DMAX (step $S_{22}$). Each time the flow returns from step $S_{22}$ to the processing at step $S_7$, "1" is added to the segment No. j.

Figure 21:
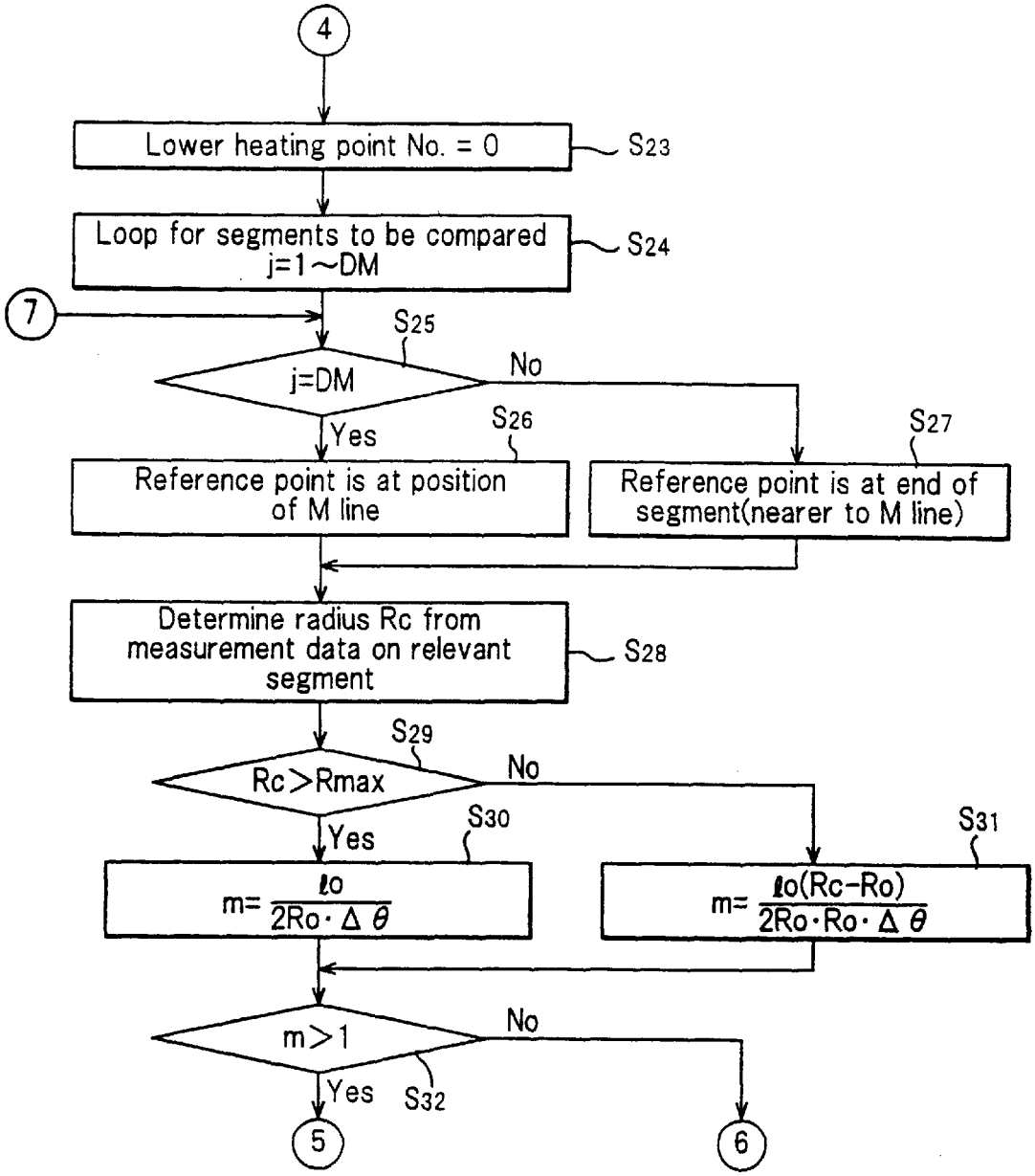
FIG. 21 is a flow chart 3 showing the further example for determination of heating points.
Figure 22:
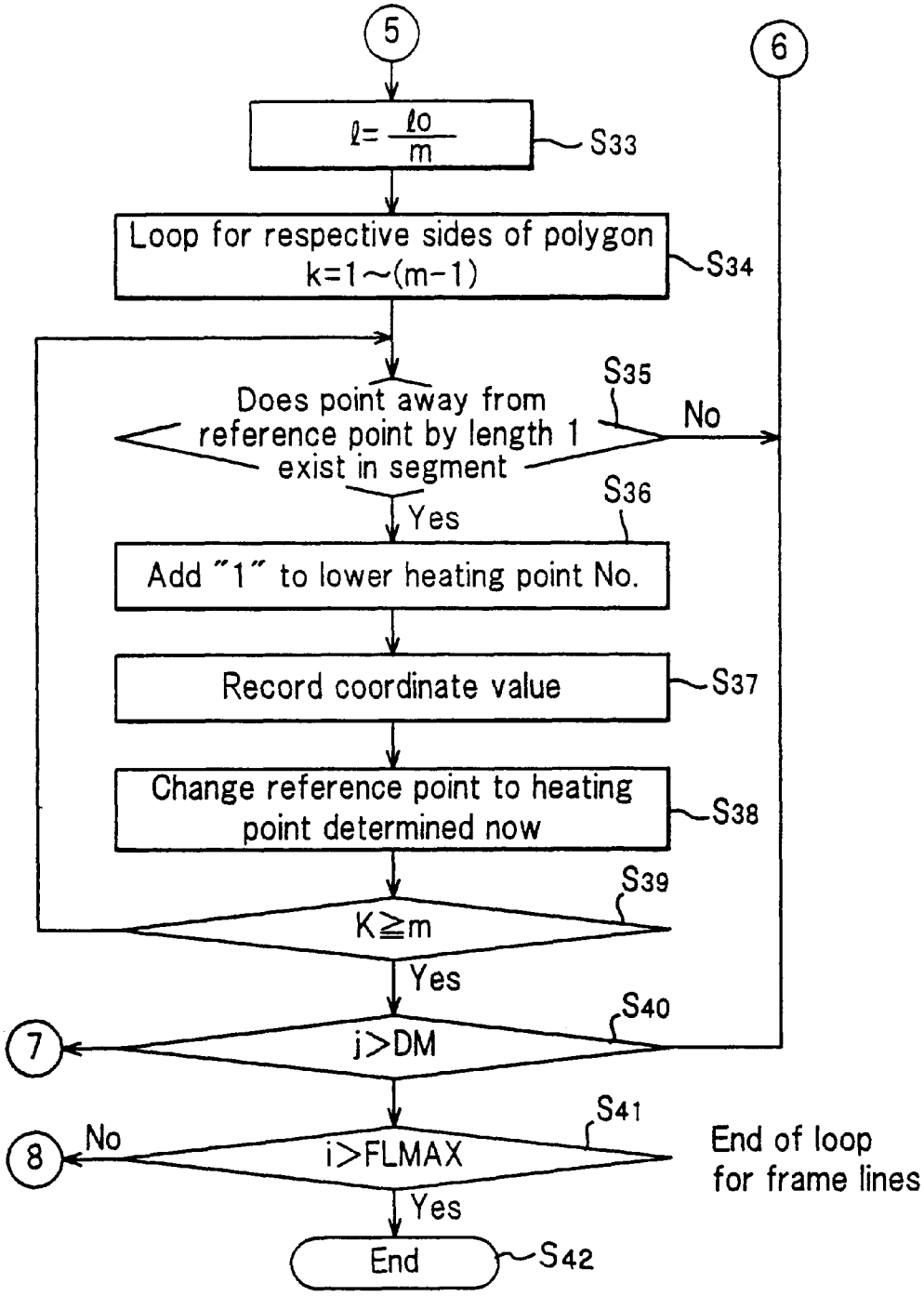
FIG. 22 is a flow chart 4 showing the further example for determination of heating points.

As shown in FIGS. 21 and 22, the following processings are performed:

23) The same processings as those at steps $S_5$ to $S_{40}$ are performed for the lower heating points (steps $S_{23}$ to $S_{40}$).
24) If the processing at step $S_{40}$ shows j>DM, this means that the upper and lower heating points have been determined for a certain frame line. Thus, the flow returns to the processing at step $S_5$, and the processings at steps $S_5$ through $S_{40}$ are repeated until i>FLMAX (step $S_{41}$). Each time the flow returns from step $S_{41}$ to the processing at step $S_5$, "1" is added to the frame line No. i. When i>FLMAX, all the processings are completed (step $S_{42}$).

A concrete procedure using the heating line determining unit 14 for determining the heating lines based on the heating points that have been determined by the curvature comparison method is the same as that described in the flow charts for the aforementioned embodiment (FIGS. 11 to 13). That is, the three-dimensional data on the heating points on the respective frame lines obtained at step $S_{19}$ of FIG. 20 and step $S_{37}$ of FIG. 22 are entered for "Enter sequence of heating points" at step $S_{21}$ of FIG. 11.

What is claimed is:

1. A method for determining a heating point in the bending of a steel plate, comprising:

determining the number of a plurality of congruent isosceles triangles, which are connected together while sharing their equal sides, on the basis of the radius of a curve of a target shape of the steel plate to be bent, the radius of a curve of a measured shape of the steel plate, and a separately set bending angle of the steel plate so that when the curve of the target shape of the steel plate is regarded as an arc, the arc of the target shape of the steel plate can be approximated by a fold line defined by the bases of the plural congruent isosceles triangles and that when the curve of the measured shape of the steel plate is regarded as an arc, the arc of the measured shape of the steel plate can be approximated by a fold line defined by the bases of a plurality of other congruent isosceles triangles which are connected together while sharing their equal sides, the number of the latter isosceles triangles being the same as the number of the former isosceles triangles whose bases constitute the approximating fold line for the target shape;

dividing the arc of the measured shape by the number of the isosceles triangles to form respective points on the arc; and using the respective points as heating points.

2. A method for determining a heating point in the bending of a steel plate, comprising:

dividing a curve of a target shape of the steel plate to be bent, into a plurality of successive segments;

similarly dividing a curve of a measured shape of the steel plate into a plurality of successive segments in correspondence with the curve of the target shape;

determining the number of a plurality of congruent isosceles triangles, which are connected together while sharing their equal sides, for each segment on the basis of the radius of a division of the curve in each segment of the target shape of the steel plate, the radius of a division of the curve in each segment of the measured shape of the steel plate, and a separately set bending angle of the steel plate so that when the division of the curve in each segment of the target shape of the steel plate is regarded as an arc, the arc in each segment of the target shape of the steel plate can be approximated by a fold line defined by the bases of the plural congruent isosceles triangles and that when the division of the curve in each segment of the measured shape of the steel plate is regarded as an arc, the arc in each segment of the measured shape of the steel plate can be approximated by a fold line defined by the bases of a plurality of other congruent isosceles triangles which are connected together while sharing their equal sides, the number of the latter isosceles triangles being the same as the number of the former isosceles triangles whose bases constitute the approximating fold line for the target shape;

dividing the arc of the measured shape in each segment by the number of the isosceles triangles to form respective points on the arc; and using the respective points as heating points.

3. A system for determining a heating point in the bending of a steel plate, comprising:

a heating point determining unit which reads in target shape data on a target shape of a steel plate to be bent, and steel plate shape measurement data to be obtained by measuring a surface shape of the steel plate;

determines the number of a plurality of congruent isosceles triangles, which are connected together while sharing their equal sides, on the basis of the radius of a curve of the target shape of the steel plate, the radius of a curve of the measured shape of the steel plate, and a separately set bending angle of the steel plate so that when the curve of the target shape of the steel plate is regarded as an arc, the arc of the target shape of the steel plate can be approximated by a fold line defined by the bases of the plural congruent isosceles triangles and that when the curve of the measured shape of the steel plate is regarded as an arc, the arc of the measured shape of the steel plate can be approximated by a fold line defined by the bases of a plurality of other congruent isosceles triangles which are connected together while sharing their equal sides, the number of the latter isosceles triangles being the same as the number of the former isosceles triangles whose bases constitute the approximating fold line for the target shape;

divides the arc of the measured shape by the number of the isosceles triangles to form respective points on the arc; and calculates the coordinates of the respective points as heating points.

4. A system for determining a heating point in the bending of a steel plate, comprising:

a heating point determining unit which reads in target shape data on a target shape of a steel plate to be bent, and steel plate shape measurement data to be obtained by measuring a surface shape of the steel plate;

divides a curve of the target shape of the steel plate into a plurality of successive segments;

similarly divides a curve of the measured shape of the steel plate into a plurality of successive segments in correspondence with the curve of the target shape;

determines the number of a plurality of congruent isosceles triangles, which are connected together while sharing their equal sides, for each segment on the basis of the radius of a division of the curve in each segment of the target shape of the steel plate, the radius of a division of the curve in each segment of the measured shape of the steel plate, and a separately set bending angle of the steel plate so that when the division of the curve in each segment of the target shape of the steel plate is regarded as an arc, the arc in each segment of the target shape of the steel plate can be approximated by a fold line defined by the bases of the plural congruent isosceles triangles and that when the division of the curve in each segment of the measured shape of the steel plate is regarded as an arc, the arc in each segment of the measured shape of the steel plate can be approximated by a fold line defined by the bases of a plurality of other congruent isosceles triangles which are connected together while sharing their equal sides, the number of the latter isosceles triangles being the same as the number of the former isosceles triangles whose bases constitute the approximating fold line for the target shape;

divides the arc of the measured shape in each segment by the number of the isosceles triangles to form respective points on the arc; and calculates the coordinates of the respective points as heating points.

* * * * *